US006095640A

United States Patent [19]

Ishinaga et al.

[11] Patent Number: 6,095,640

[45] Date of Patent: Aug. 1, 2000

[54] LIQUID DISCHARGE HEAD, LIQUID DISCHARGE METHOD, HEAD CARTRIDGE AND LIQUID DISCHARGE DEVICE

[75] Inventors: Hiroyuki Ishinaga, Tokyo; Masahiko Ogawa, Hino; Masami Ikeda, Tokyo; Ichiro Saito, Yokohoma; Tomoyuki Hiroki, Zama; Yoshiyuki Imanaka, Kawasaki; Teruo Ozaki, Yokohama; Masahiko Kubota, Tokyo; Yoichi Taneya, Yokohama; Hiroyuki Sugiyama, Sagamihara, all of Japan

[73] Assignee: Canon Kabushiki Kaisha, Tokyo, Japan

[21] Appl. No.: 09/205,726

[22] Filed: Dec. 4, 1998

[30] Foreign Application Priority Data

Dec. 5, 1997 [JP] Japan ..... 9-336107

[51] Int. Cl.[7] ..... B41J 2/05

[52] U.S. Cl. ..... 347/65; 347/47

[58] Field of Search ..... 347/63, 65, 47, 347/45

[56] References Cited

U.S. PATENT DOCUMENTS

| | | |
|---|---|---|
| 4,412,224 | 10/1983 | Sugitani . |
| 4,417,251 | 11/1983 | Sugitani . |
| 4,437,100 | 3/1984 | Sugitani et al. . |
| 4,450,455 | 5/1984 | Sugitani et al. . |
| 4,480,259 | 10/1984 | Kruger et al. . |
| 4,496,960 | 1/1985 | Fischbeck . |
| 4,509,063 | 4/1985 | Sugitani et al. . |
| 4,521,787 | 6/1985 | Yokota et al. . |
| 4,558,333 | 12/1985 | Sugitani et al. . |
| 4,568,953 | 2/1986 | Aoki et al. . |
| 4,609,427 | 9/1986 | Inamoto et al. . |
| 4,611,219 | 9/1986 | Sugitani et al. . |
| 4,646,120 | 2/1987 | Ikeda et al. . |
| 4,666,823 | 5/1987 | Yokota et al. . |
| 4,723,129 | 2/1988 | Endo et al. . |
| 4,994,825 | 2/1991 | Saito et al. . |
| 5,095,321 | 3/1992 | Saito et al. . |
| 5,208,604 | 5/1993 | Watanabe et al. . |
| 5,262,802 | 11/1993 | Karita et al. . |
| 5,278,585 | 1/1994 | Karz et al. . |
| 5,389,957 | 2/1995 | Kimura et al. . |
| 5,485,184 | 1/1996 | Nakagomi et al. . |
| 5,821,962 | 10/1998 | Kudo et al. ..... 347/67 |
| 5,940,957 | 8/1999 | Goto et al. . |

FOREIGN PATENT DOCUMENTS

| | | |
|---|---|---|
| 0 160 463 | 11/1985 | European Pat. Off. . |
| 0 436 047 | 7/1991 | European Pat. Off. . |
| 443 798 A2 | 8/1991 | European Pat. Off. . |
| 55-81172 | 6/1980 | Japan . |
| 61-69467 | 4/1986 | Japan . |
| 61-110557 | 5/1986 | Japan . |
| 62-156969 | 7/1987 | Japan . |
| 63-28654 | 2/1988 | Japan . |
| 63-197652 | 8/1988 | Japan . |
| 63-199972 | 8/1988 | Japan . |
| 3-81155 | 4/1991 | Japan . |
| 4-118248 | 4/1992 | Japan . |
| 5-124189 | 5/1993 | Japan . |
| 5-229122 | 9/1993 | Japan . |
| 6-87214 | 3/1994 | Japan . |

*Primary Examiner*—John Barlow
*Assistant Examiner*—Juanita Stephens
*Attorney, Agent, or Firm*—Fitzpatrick, Cella, Harper & Scinto

[57] ABSTRACT

In accordance with the present invention, there is provided a liquid discharge head comprising a discharge port for discharging liquid, a liquid flow path provided with a bubble generation means for generating bubbles in liquid and communicated with the discharge port, and a movable member provided facing said bubble generation means in said liquid flow path and having a free end on a downstream side toward the discharge port, a first surface provided with the bubble generation means being continued to at least one second surface of the side wall surface of said liquid flow path and the front end surface having the opening of the discharge port with a curved surface, the first surface being one of surfaces forming the liquid flow path.

14 Claims, 15 Drawing Sheets

FIG. 9A1
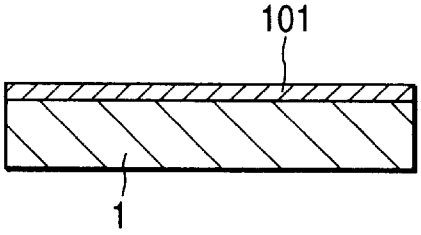
FIG. 9A2
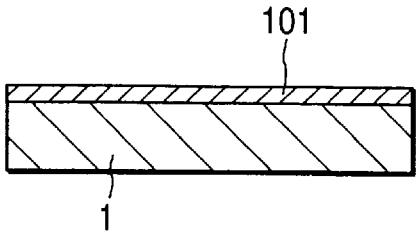
FIG. 9B1
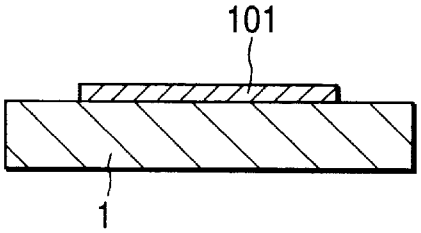
FIG. 9B2
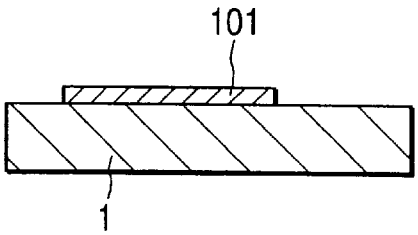
FIG. 9C1
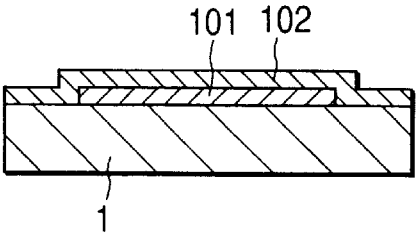
FIG. 9C2
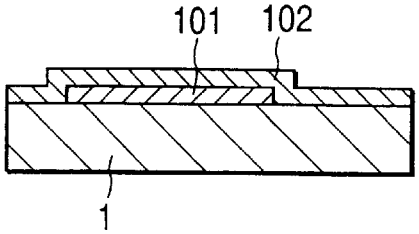
FIG. 9D1
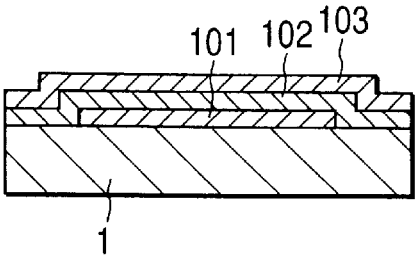
FIG. 9D2
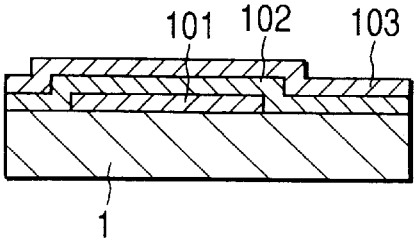

FIG. 9E1
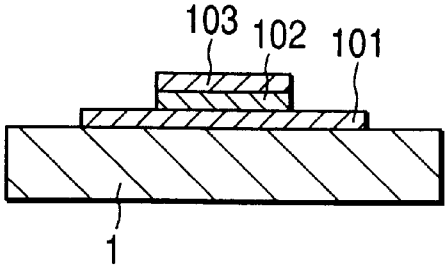
FIG. 9E2
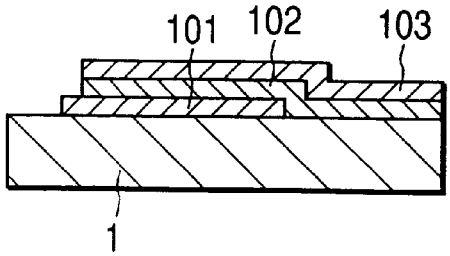
FIG. 9F1
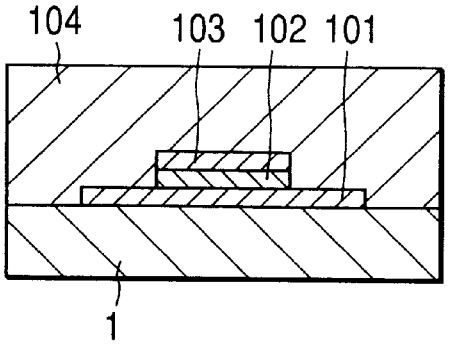
FIG. 9F2
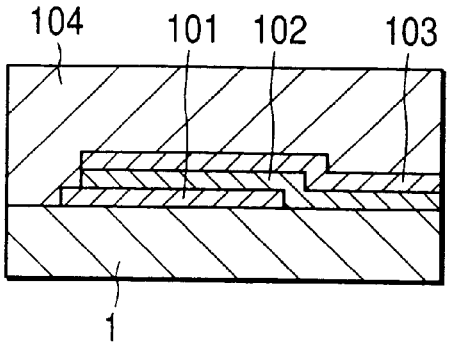
FIG. 9G1
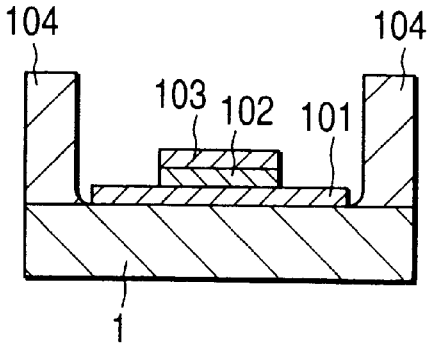
FIG. 9G2
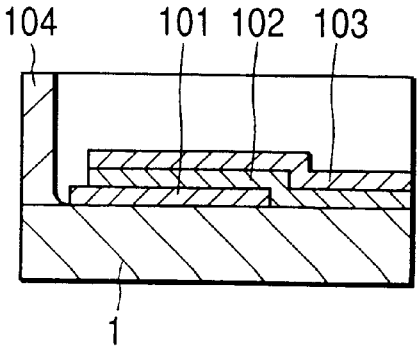

FIG. 9H1
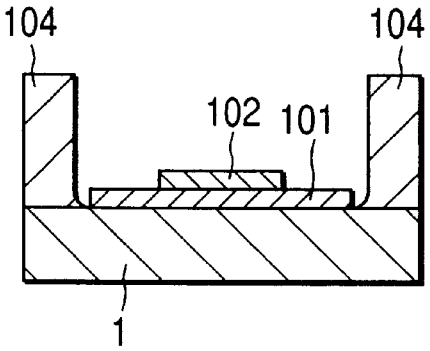
FIG. 9H2
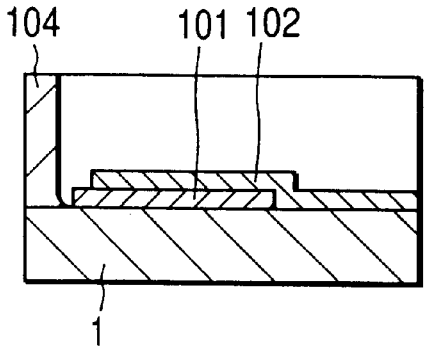
FIG. 9I1
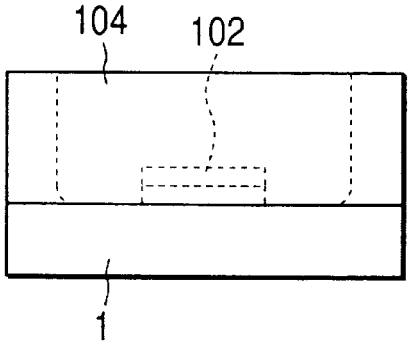
FIG. 9I2
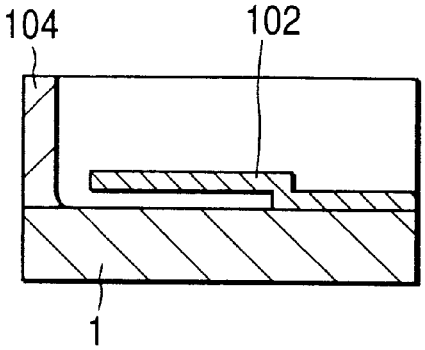
FIG. 9J1
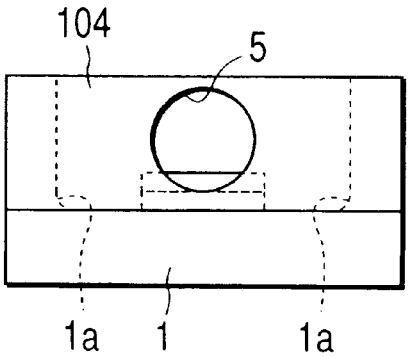
FIG. 9J2
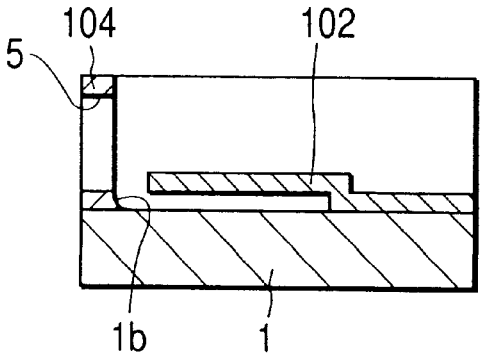

LIQUID DISCHARGE HEAD, LIQUID DISCHARGE METHOD, HEAD CARTRIDGE AND LIQUID DISCHARGE DEVICE

BACKGROUND OF THE INVENTION

1. Field of the Invention

The present invention relates to a liquid discharge head for discharging liquid by bubble generation due to the action of heat energy on liquid, a head cartridge using the liquid discharge head, and a liquid discharge device. Further, the present invention relates to a new liquid discharge method including displacement of a movable member and bubble growth, a liquid discharge head, a head cartridge and a liquid discharge device for carrying out this liquid discharge method.

The present invention is an invention which can be applied to devices such as a printer which records on a recording medium, such as paper, thread, fiber, cloth, leather, metal, glass, ceramics and the like, a copy machine, a facsimile including a communication system, and a word processor including a printer section. Further the present invention can be applied to an industrial recording device compositely combined with each type of processing unit. A term "recording" means not only imparting an image having a meaning of a character and a figure or pattern etc., on a recording medium but also imparting an image having no meaning of the pattern etc., thereon.

2. Related Background Art

An ink jet recording process, so called a bubble jet recording process, in which a state change including a rapid volume change of ink (i.e., generation of bubbles) is caused to generate by imparting energy such as heat or the like to the ink, the ink is discharged from a discharge port by an active force due to this state change and the discharged ink is adhered to a medium to be recorded to perform an image formation, has been well known. In the recording device using this bubble jet recording process, as disclosed in publications of the specification of U.S. Pat. No. 4,723,129 and the like, there are generally provided a discharge port for discharging ink, an ink flow path communicated with this discharge port and an electrothermal converting member used as an energy generating means for discharging ink provided in the ink flow path.

According to such recording process, a high quality level image can be recorded at high speed and low noise and a discharge port for discharging ink can be provided at high density in a head in this recording process. Therefore, the recording process has a number of the advantages that a high revolution recording image and such color image could easily be obtained in a compact device. Thus, this bubble jet recording process has recently been used in various office equipment such as a printer, copy machine, facsimile and the like. Further, the recording process is used even in an industrial system such as a printing equipment etc.

With the increased use of the bubble jet technology in products in many fields, the following various demands are recently increased.

For example, an answer to demand of improvement of energy efficiency includes optimization of a heating element in which thickness of a protective film is controlled. This technology has an advantage in that the transmission efficiency of generated heat to liquid is enhanced.

Further, to obtain an extended definition image, there is provided a driving condition for imparting a liquid discharging method in which an improved ink discharge based on a stable bubble generation can be performed. Furthermore, to obtain a liquid discharge head having a high refilling speed of a discharged liquid to a liquid flow path from the viewpoint of the high speed recording, there is also provided a liquid discharge head having improved shapes of the liquid flow path.

A flow path structure and a head producing method disclosed in Japanese Patent Application Laid-Open No. 63-199972, relating to the shapes of the flow path, are patents that take notice of a back wave (pressure in a direction opposite to that toward a discharge port, that is pressure toward a liquid chamber) which is generated with the generation bubbles. This back wave is known as a loss energy since it is not an energy toward the discharge direction.

A head disclosed in the Japanese Patent Application Laid-Open No. 63-199972, has an ink jet head valve which is spaced from a bubbling area of bubbles formed by the heating element and is positioned at the opposite side to the discharge port with respect to the heating element. This valve has an initial position in a manner that it is adhered to the ceiling of the flow path by a head producing method using a plate material, and is hung down in the flow path with the generation of bubbles. This patent is disclosed as a patent in which an energy loss is controlled by controlling a part of the above-mentioned back wave with a valve.

However, in this configuration, as will be found by studying bubble behaviors in a liquid flow path just before and after bubble generation in the flow path supporting liquid to be discharged, suppression of a part of a back wave with a valve is not necessarily useful for discharging liquid. The back wave itself has no direct relation to the discharge of liquid by nature. Therefore, even though a part of the back wave was suppressed, the suppression does not impart a great influence to the discharge of liquid.

SUMMARY OF THE INVENTION

The main object of the present invention is to enhance the fundamental discharge properties in a method of discharging liquid by forming bubbles (particularly, bubbles are generated by film boiling) in a liquid flow path, to a level which could not be expected conventionally. The enhancement of the discharge properties was attained by view points which could not be thought.

A part of the present inventors has studied to provide a new liquid drop discharge method using bubbles, which were not obtained, and a head used therein and the like, by reviewing the principles of the liquid droplet discharge. Further the present inventors have made a first technical analysis which starts from the movement of a movable member in a liquid flow path and analyzes the principle of a mechanism of the movable member in the liquid flow path; a second analysis which starts from the principle of the liquid droplet discharge with bubbles; and a third analysis which starts a bubble generation region in a heating element for generating bubbles.

By these first, second and third analyses, quite a new technology for actively controlling the bubbles has been established by allowing the movable member to face the heating element or bubble generation region. Another feature of the present invention is to efficiently displace the bubble growth components on the downstream side to a discharge direction, based on the knowledge of the facts that, taking the energy which bubbles themselves impart to the discharge quantity into consideration, utilization of the bubble growth components on the downstream is a maximum function which can remarkably enhance the discharge properties. Such efficient displacement of the bubbles can lead to enhancements of the liquid discharge efficiency and liquid discharge speed.

The present invention provides a new liquid discharge method and liquid discharge principle which can further improve the above-mentioned epoch-making liquid discharge principle. That is, in the present invention, a principle which can further enhance the liquid discharge efficiency was studied by recognizing the relationship between the displacement of the free end of the movable member and the growth of bubbles obtained from the bubble generation region.

Further, a point that the present inventors have recognized is one that the structure of the liquid flow path greatly contributes to a more efficient use of the above-mentioned liquid discharge principle and to attainment of a higher liquid discharge efficiency and liquid discharge output, so that the liquid flow derived from the bubble growth is efficiently controlled and the displacement of the movable member is efficiently made.

The main object of the present invention is to provide a liquid discharge head, liquid discharge method, head cartridge and liquid discharge device which can further stabilize and enhance the liquid discharge efficiency by aiding the displacement of a movable member over the above-mentioned epock-making liquid discharge principle.

In accordance with one aspect of the present invention, there is provided a liquid discharge head comprising a discharge port for discharging liquid, a liquid flow path provided with a bubble generation means for generating bubbles in liquid and communicated with the discharge port, and a movable member provided facing the bubble generation means in the liquid flow path and having a free end on a downstream side toward the discharge port, a first surface provided with the bubble generation means being continued to at least one second surface of the side wall surface of the liquid flow path and the front end surface having the opening of the discharge port with a curved surface, the first surface being one of surfaces forming the liquid flow path.

In accordance with another aspect of the present invention, there is provided a liquid discharge method for discharging liquid by using a liquid discharge head comprising a discharge port for discharging liquid, a liquid flow path provided with a bubble generation means for generating bubbles in liquid and communicated with the discharge port, and a movable member provided facing the bubble generation means in the liquid flow path and having a free end on a downstream side toward the discharge port, a first surface provided with the bubble generation means being continued to at least one second surface of the side wall surface of the liquid flow path and the front end surface having the opening of the discharge port with a curved surface, the first surface being one of surfaces forming the liquid flow path, and displacing the free end of the movable member due to the generation of the bubbles thereby leading the pressure to the discharge port to discharge liquid, wherein when the movable member is displaced due to the generation of the bubbles, liquid is flowed between the movable member and the liquid flow path along the curved surface by the growth of the bubbles.

In the present invention, a first surface provided with the bubble generation means is continued to at least one second surface of the side wall surface of the liquid flow path and the front end surface having the opening of the discharge port with a curved surface, the first surface being one of surfaces forming the liquid flow path. Liquid is flowed between the movable member and liquid flow path along the curved surface by the pressure due to the generation of bubbles. As a result, this liquid flow supports the movable member, and a displacement motion of the movable member and the growth of bubbles are stably made. Accordingly, discharge properties can be enhanced and at the same time the durability of the movable member itself can also be enhanced.

On the other hand, in a contraction process of bubbles, eddy flows are generated around the bubble generation means by the curved face. The eddy flows allow bubbles to separate from the bubble generation means, thereby preventing cavitation impact which is generated upon the disappearance of bubbles, from being directly imparted to the bubble generation means. Thus, the life of the bubble generation means can be enhanced.

In order to effectively generate a flow of the above-mentioned liquid, it is preferable that a width of the liquid flow path is gradually increased in a direction where the displacement of the movable is increased, and that the above-mentioned curved surface is formed so that the concave surface thereof faces a surface provided with the bubble generation means. It is preferable that the curvature of this concave surface is in a range of 2 $\mu$m to 20 $\mu$m.

The terms "upstream" and "downstream" used in this invention are represented as expressions relating to directions in a liquid flow directed from a source of supply for liquid to a bubble discharge port through the bubble generation region (or movable means). Also, the term "downstream side" relating to bubbles themselves represents a bubble discharge port side section which directly and mainly acts on the discharge of liquid droplets. More particularly, the term "downstream side" means bubbles which are generated in a region on a downstream side from the center of a bubble relating to the direction of a flow, or on a downstream side from the center of the surface area of the heating element.

Other objects of the present invention will be understood from the following descriptions by those skilled in the art.

BRIEF DESCRIPTION OF DRAWINGS

FIG. 1A is a longitudinal-sectional view taken along the direction of a liquid flow path, and FIG. 1B is a cross-sectional view of the liquid flow path;

FIG. 4A is a longitudinal-sectional view taken along the direction of a liquid flow path, and FIG. 4B is a cross-sectional view of the liquid flow path;

FIG. 5A is a longitudinal-sectional view of the liquid flow path, and FIG. 5B is a cross-sectional view thereof;

FIG. 6A is a longitudinal-sectional view taken along the direction of a liquid flow path, and FIG. 6B is a cross-sectional view of the liquid flow path;

FIGS. 9A1, 9A2, 9B1, 9B2, 9C1, 9C2, 9D1, 9D2, 9E1, 9E2, 9F1, 9F2, 9G1, 9G2, 9H1, 9H2, 9I1, 9I2, 9J1 and 9J2 are step views showing a production method of a liquid discharge head according to the present invention, particularly, FIGS. 9A1, 9B1, 9C1, 9D1, 9E1, 9F1, 9G1, 9H1, 9I1 and 9J1 are sectional views in a direction vertical to the direction of a liquid flow path, FIGS. 9I1 and 9J1 are front views in a direction vertical to the direction of the liquid flow path, and FIGS. 9A2, 9B2, 9C2, 9D2, 9E2, 9F2, 9G2, 9H2, 9I2 and 9J2 are cross-sectional views taken along the direction of the liquid flow path;

DETAILED DESCRIPTION OF THE PREFERRED EMBODIMENTS

The present invention will be described in detail by embodiments hereinbelow.

First Embodiment

Figure 1A:
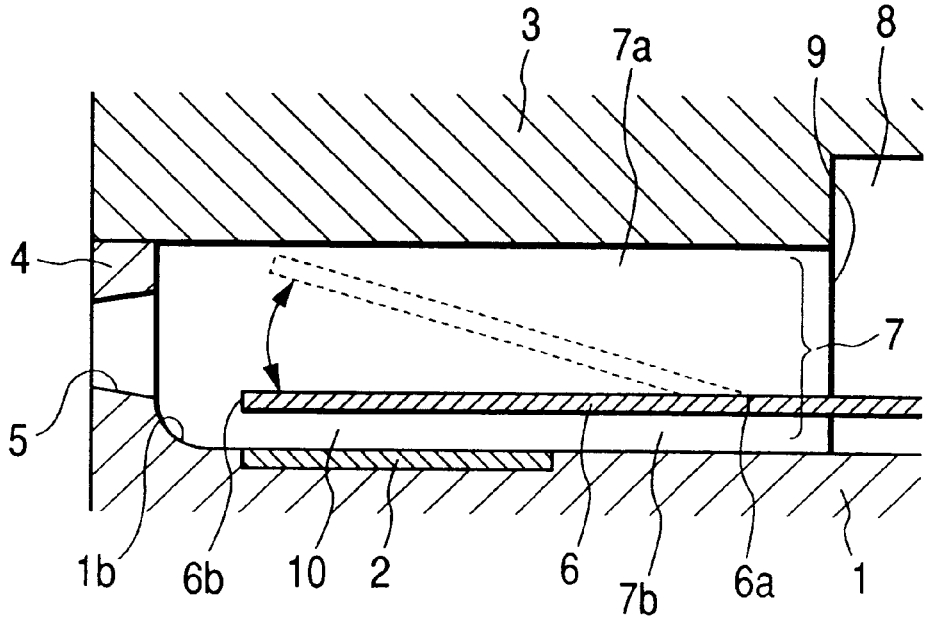
FIGS. 1A and 1B are views of a liquid discharge head of a first embodiment according to the present invention, particularly.
Figure 1B:
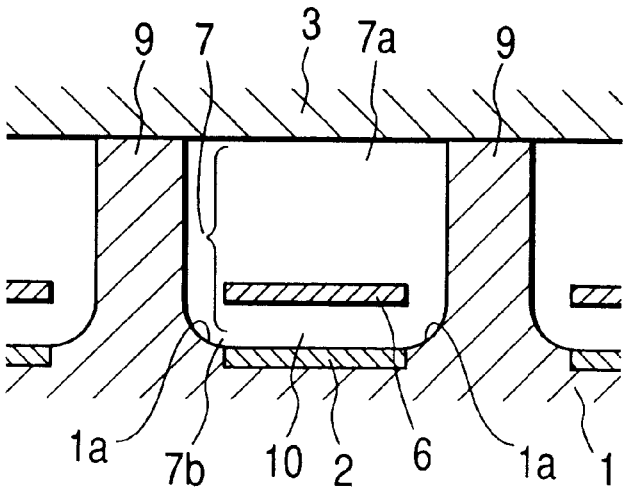

FIGS. 1A and 1B are views showing a liquid discharge head of a first embodiment according to the present invention. Particularly, FIG. 1A is a sectional view along the direction of the liquid flow path and FIG. 1B is a cross-sectional view of the liquid flow path. The liquid discharge head of the present embodiment includes an element substrate 1 provided with a plurality of heating element in parallel, which imparts a heat energy for generating bubbles in liquid, a top plate 3 connected to this element substrate 1, and a movable member 6 provided in a liquid flow path 7 formed by the element substrate 1 and top plate 3.

The element substrate 1 is a member having a plurality of grooves a part of which was partitioned with a plurality of liquid flow path side walls provided in parallel with a space to each other. By connection of the element substrate to the top plate 3, these groove portions form a liquid flow path 7. The front end portion (the left end portion of FIG. 1A) of the element substrate 1 is provided with an orifice plate section 4 having each discharge port 5 formed at positions corresponding to each groove. The posterior portion (more right side portion than a liquid flow path side wall 9) of the liquid flow path side wall 9 forms a common liquid chamber 8 for applying each liquid flow path 7 with liquid by the connection of the element substrate to the top plate 3. Each liquid discharge port 5 is communicated with a common liquid chamber 8 through the respective liquid flow paths 7. The element substrate 1 is composed of a silicon substrate. The orifice plate section 4 and flow path side wall 9 is integrally formed with the element substrate 1 by a process of forming films on this silicon substrate as will be described later.

The heating element 2 is arranged on a base wall portion of the liquid flow path 7 between the respective flow path side walls 9. Between the respective flow path side walls 9 is formed a silicon oxide film or silicon nitride film on the element substrate 1 for the purpose of insulation and heat accumulation.

On the silicon oxide film or silicon nitride film is patterned an electric resistance layer forming the heating element 2, and wiring. The heating element 2 is heated by applying voltage to the electric resistance layer through the wiring to allow current to flow the electric resistance layer.

A surface provided with the heating element 2 of the liquid flow path 7 is smoothly connected to an inner surface of the orifice plate section 4 and a side surface of the flow path side wall 9 while forming curved surfaces 1*a* and 1*b* having a constant curvature of 5 $\mu$m respectively.

The top plate 3 is connected onto the element substrate 1 to form the liquid flow path 7 and common liquid chamber together with the element substrate 1. A concave portion is formed in a portion of the top plate 3. The concave portion acts as a common liquid chamber 8. The top plate 3 is also composed of a silicon type material. The concave portion of the top plate 3, which forms the common liquid chamber 8, is formed by an etching process or the like.

The movable member 6 is provided in a cantilever type, while facing the heating element 2 so as to divide the liquid flow path 7 into a first liquid flow path 7*a* communicated with the discharge port, and a second liquid flow path 7*b* including the heating element 2. The movable member 6 is a thin film composed of a silicon type material such as silicon nitride or silicon oxide etc.

This movable member 6 is provided at a position facing the heating element 2 while having a desired distance from the heating element 2 and covering it. The movable member 6 has a fulcrum 6*a* on the upstream side of a large flow which flows from the common liquid chamber 8 to the discharge port side through the movable member 6 by the discharge operation of liquid, and a free end 6*b* on the downstream side with respect to the fulcrum 6*a*. Thus, the movable member 6 is provided so that the free end side of the movable member 6 can be displaced upwardly, as shown by a broken line in FIG. 1A. The space between this heating element 2 and movable member 6 becomes a bubble generation region 10.

As mentioned above, since the element substrate including the heating element 2 and orifice plate section 4, and the movable member 6 are composed of a silicon type material, they are produced by using a semiconductor wafer process technology. The details thereof will be described later.

Now, a discharge operation or motion in a liquid discharge head shown in FIGS. 1A and 1B will be described in detail, with reference to FIGS. 2A to 2D and 3A to 3D. FIGS. 2A to 2D are sectional views along the liquid flow path for explaining a discharge operation of the liquid discharge head shown in FIGS. 1A and 1B. FIGS. 3A to 3D are cross-sectional views of the liquid flow path for explaining a discharge operation of the liquid discharge head shown in FIGS. 1A and 1B. The respective steps of FIGS. 3A to 3D correspond to the respective steps of FIGS. 2A to 2D.

Figure 2A:
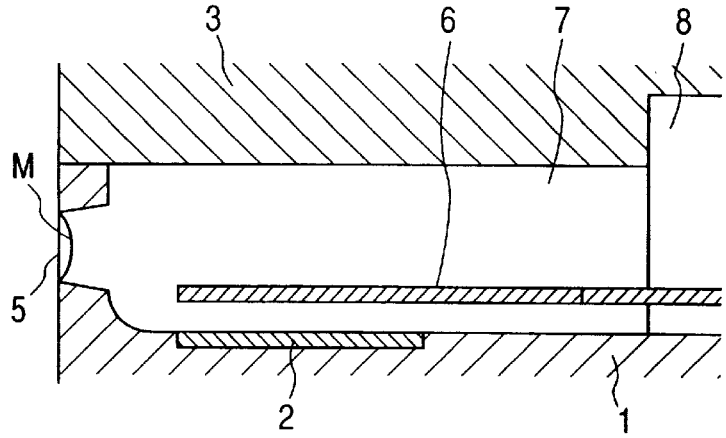
FIGS. 2A, 2B, 2C and 2D are a longitudinal-sectional views taken along the liquid flow path for explaining a discharge operation for the liquid discharge head shown in FIGS. 1A and 1B.
Figure 3A:
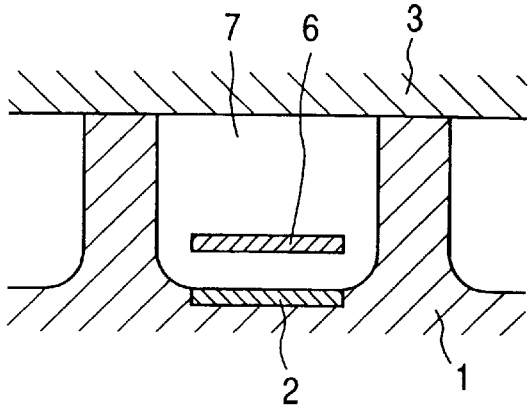
FIGS. 3A, 3B, 3C and 3D are cross-sectional views of the liquid flow path for explaining a discharge operation for the liquid discharge head shown in FIGS. 1A and 1B.

FIGS. 2A and 3A each shows a state before application of an electric energy to the heating element and before heat generation of the heating element 2. In this state, liquid supplied to the common liquid chamber 8 advances into the liquid flow path 7 by the capillarity and forms a meniscus M at the discharge port 5 with the liquid flow path filled with liquid. In this case, it is important that the movable member 6 is provided at a position facing at least the downstream side portion of the bubbles generated by heating the heating element 2. That is, the movable member 6 is extended to a downstream side position from at least the surface area center of the heating element in a structure of a liquid flow path so that the downstream side of the bubbles acts on the movable member 6.

Figure 2B:
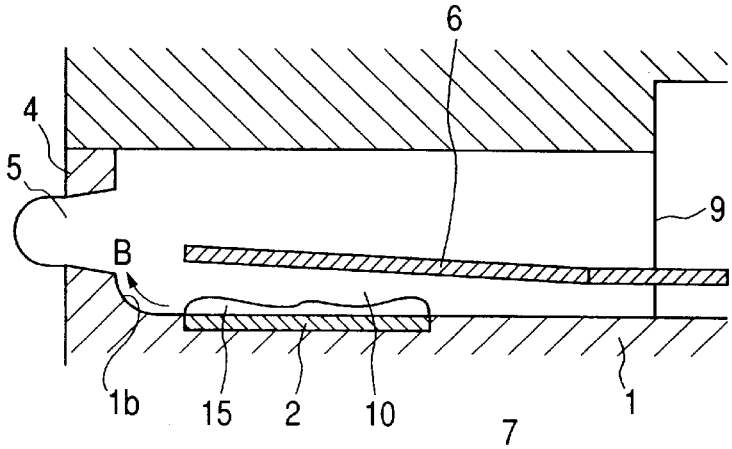
Figure 3B:
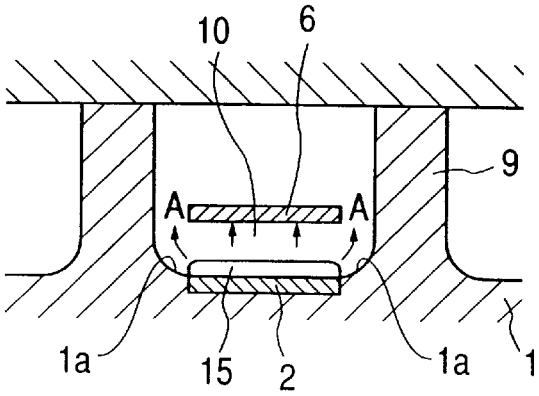

FIGS. 2B and 3B each shows a state where electric energy was applied to the heating element 2 to heat the heating element 2, a part of liquid filling the bubble generation region 10 was heated with the generated heat and bubbles 15 were generated by film boiling.

In such state, the movable member 6 is displaced by the pressure due to generation of the bubbles 15 so as to lead a direction of the pressure propagation of the bubbles 15 toward the discharge port, while keeping liquid between the bubbles 15 and the movable member 15. Further, flows A and B of the liquid which were in the bubble generation region 10 are generated by generation of bubbles 15.

The flow A which is flowed toward the flow path side wall 9 is flowed between the movable member 6 and flow path side wall 9 along the curved surface 1*a* which continuously connects a heating element-mounted surface of the element substrate 1 to a side wall of the flow path side wall 9. Accordingly, the sides of the movable member 6 are supported by the flowed liquid against the flow path side walls 9, whereby a slight movement of the movable member 6 toward the flow path side walls 9 can be restrained during a desired displacement thereof. Therefore, the desired displacement of the movable member 6 is smoothly made. Even in an ink jet head in which a movable member 6 is very close to flow path side walls 9, no contact is made between the movable member 6 and the flow path side walls 9.

On the other hand, the flow B which is flowed from the bubble generation region 10 toward downstream through between the front end of the movable member 6 and the inner surface of the orifice plate section 4 is smoothly advanced toward the discharge port 5 by the curved surface 1*b* which continuously connects a heating element mounted surface of the element substrate to the inner surface of the orifice plate section 4. Accordingly since the flows A and B are smoothly flowed along the curved surfaces 1*a* and 1*b*, growth of bubbles 15 can be stably made.

Figure 2C:
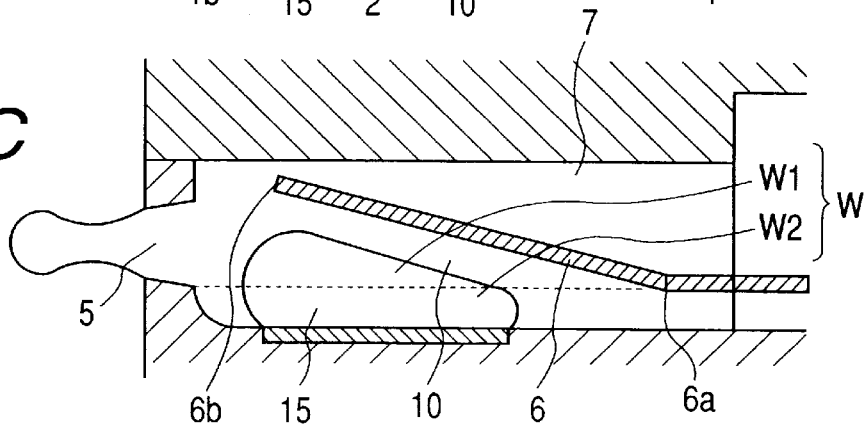
Figure 3C:
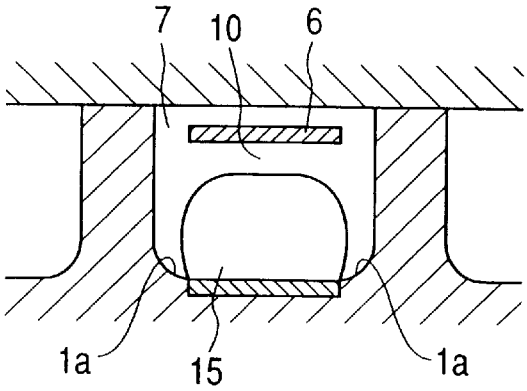

FIGS. 2C and 3C each shows a state where the bubble 15 was further grown. The pressure generated by the growth of the bubbles is preferentially acted on the movable member 6. The movable member 6 is displaced so that it is greatly opened or pivoted on the discharge port 5 side keeping the fulcrum 6*a* as the center. By the displacement of the movable member 6 or the state of the displaced thereof, propagation of pressure due to the generation of bubbles and grown bubbles themselves are led to the discharge port 5 side, whereby liquid is discharged from the discharge port 5.

Namely, by providing the movable member 6 having the fulcrum 6*a* on the upstream side of the liquid flow in the liquid flow path 7 and the free end 6*b* on the downstream side on the bubble generation region 10, the bubble pressure propagation direction is led to the downstream side and the bubble pressure directly and efficiently contributes to the discharge of liquid. Further, the bubble growth direction itself is also led to the downstream side as in the pressure propagation direction, whereby bubbles 15 are further largely grown in the downstream than in the upstream. Thus, by controlling the bubble growth direction itself with the movable member and controlling the bubble pressure propagation direction, fundamental discharge properties such as discharge efficiency, discharge output, or discharge speed etc., can be enhanced.

Further, since as explained above, the displacement of the movable member 6 is smoothly effected by the flow A from the bubble generation region 10, the movable member 6 does not almost prevent propagation of bubbles 15 and bubble pressure when the bubbles 15 and the bubble pressure are led toward the discharge port. As a result, the propagation of the pressure and the growth direction of bubbles 15 can be efficiently controlled in response to the magnitude of pressure which is propagated, thereby enhancing the stability to the liquid discharge and the discharge efficiency. On the other hand, the displacement of the movable member 6 can be smoothly effected and movement toward the side walls 9 is decreased. As a result, durability of the movable member 6 itself is enhanced.

Also, the flow B from the bubble generation region 10 is smoothly flowed toward the discharge port 5, thereby enhancing the stability to the discharge. Further, by a gradual displacement of the movable member 6 in response to the growth of bubbles 15, a direction of the pressure propagation of bubbles and an easy direction of the bubble volume movement, that is growth direction of the bubbles 15 can be uniformly oriented, whereby the discharge efficiency may be enhanced.

Figure 2D:
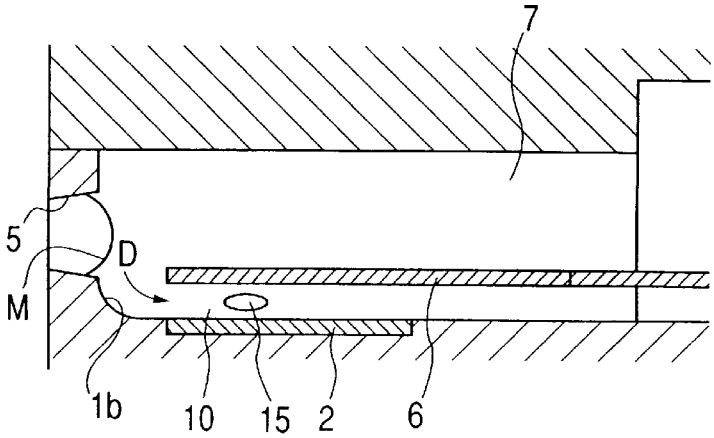
Figure 3D:
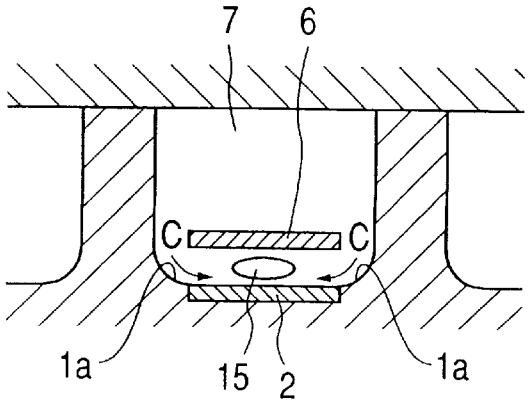

FIGS. 2D and 3D each shows a state where after the above-mentioned film boiling, the bubble 15 is contracted by the decrease of the internal pressure of the bubble 15 and vanished.

A displaced movable member 6 is returned to the first position by a negative pressure due to the contraction of the bubble 15 and a restoring force of the spring action of the movable member 6. In order to compensate the contacted volume of the bubble 15 in the bubble generation region 10 or to compensate the amount for the volume of discharged liquid during bubble vanishment, liquid is flowed from the upstream side, to refill liquid into the liquid flow path 7.

When the bubble 15 is contracted, eddy flows such as flows A and B are generated around the heating element 2 by the curved surfaces 1*a* and 1*b*. This eddy flows allow the bubble 15 to separate from the heating element 2. As a result, a large cavitation impact which is generated at vanishment of the bubble 15 is not directly imparted to the heating element 2, thereby enhancing the life of the heating element 2. Further, residual bubbles and the like which were on a corner of the liquid flow path in a conventional liquid discharge head are decreased by the continuous curved surfaces 1*a* and 1*b*. Even though a few residual bubbles are present, they can be easily discharged by the pressure of liquid flows which are refilled. Thus, the uniformity of the bubble generation can be obtained, whereby a stable liquid discharge can be accomplished.

Now, a liquid supply mechanism including the refilling of liquid will be described in detail. After the operations shown in FIGS. 2C and 3C, if the bubble 15 has the maximum volume and is in a vanishing step, liquid having a volume for compensating the volume of vanished bubble is flowed into the bubble generation region from the discharge port 5 side of the first liquid flow path 7*a* and the common liquid chamber 8 side of the second liquid flow path 7*b*. In a liquid flow path structure having no movable member 6, the amount of liquid which is flowed into the bubble vanishment position from the discharge port 5 side and the amount of liquid which is flowed thereinto from the common liquid discharge 8 side further depend on the magnitude of the flow resistance in a portion near the discharge port 5 and a portion near the common liquid chamber 8 than in the bubble generation region 10. This is based on the liquid flow resistance and the liquid inertia.

Thus, when the flow resistance of a portion near the discharge port 5 is small, most of the liquid is flowed into the bubble vanishment position from the discharge port 5 side, thereby increase the amount of recession of meniscus M. Particularly, the further the discharge efficiency is enhanced by decreasing the flow resistance of a portion near the discharge port 5, the further the amount of recession of meniscus M at the bubble vanishment is increased thereby taking a long refilling time and preventing the high speed printing.

Since a movable member 6 is provided in the present embodiment, the movable member 6 stops the recession of meniscus M when it is returned back to the first position at the bubble vanishment. If the upper volume of the volume M of a bubble is W1 and the lower volume thereof is W2, the upper and lower being defined by bordering the first position of the movable member 6, as shown in FIG. 2C, liquid having the volume of W2 at the stopping of recession of the meniscus M is supplied by the flow in the second liquid flow path 7*b*. Therefore, although the amount of the bubble 15 corresponding to a half of the volume W of the bubble 15 was the amount of recession of a meniscus conventionally, the amount of recession of a meniscus could be decreased to W1 which is a half of the conventional level in the present embodiment.

Further, liquid having the volume of W2 can be forcibly and mainly supplied from the upstream side of the second liquid flow path 7*b* along the heating element 2 side surface of the movable member 6, by utilizing the pressure at the bubble vanishment. Accordingly, a more speedy refilling of the liquid could be realized.

The feature of this liquid supply mechanism resides in that in a conventional method, when refilling of liquid, which uses pressure at the bubble vanishment in an ink jet head having no movable member 6, is made, the vibration of the meniscus M was increased, thereby leading to deterioration of an image quality level, but, in a high speed the refilling according to the present embodiment, liquid flows in the first liquid flow path 7*a* and the bubble generation region 10 can be decreased on the discharge port 5 side, whereby the vibration of the meniscus M can be reduced remarkably.

Thus, in the present embodiment of the present invention, a high speed refilling of liquid can be attained by the forced refilling from the second liquid flow path 7*b* to the bubble generation region 10, and the prevention of the recession and vibration of the meniscus. As a result, when the stability of liquid discharge and high speed discharge of the present invention is used in a field of recording, an enhancement of image quality and a high speed recording and the like can be realized.

The configuration of the present invention further includes the following effective function. The function is to prevent an upstream propagation of most of the pressure generated by bubbles on the common liquid chamber 8 side (upstream side), the bubbles being generated on the heating element 2, acted as forces which allow liquid to back to the upstream side, the force being referred to a back wave as mentioned above. The back wave generated an upstream side pressure and a liquid movement due to the pressure, and further an inertia force due to the liquid movement. Such inertia force and the like reduced refilling of liquid into the liquid flow path 7 thereby preventing a high speed driving. In the present invention, even the action of the back wave, which is applied to the upstream side, is prevented by the provision of the movable member 31, whereby refilling properties can be further enhanced.

An embodiment of the present invention was mainly described from view points of liquid discharge operation and refilling operation. Further, the above-mentioned curved surfaces 1*a* and 1*b*, each has an action, which allows stress applied to the border between the element substrate 1 and the orifice plate section 4 to disperse. As a result, the strength in the flow path side walls 9 and orifice plate section 4 is enhanced and the durability of the discharge head is also enhanced during the production and use thereof.

Second Embodiment

Figure 4A:
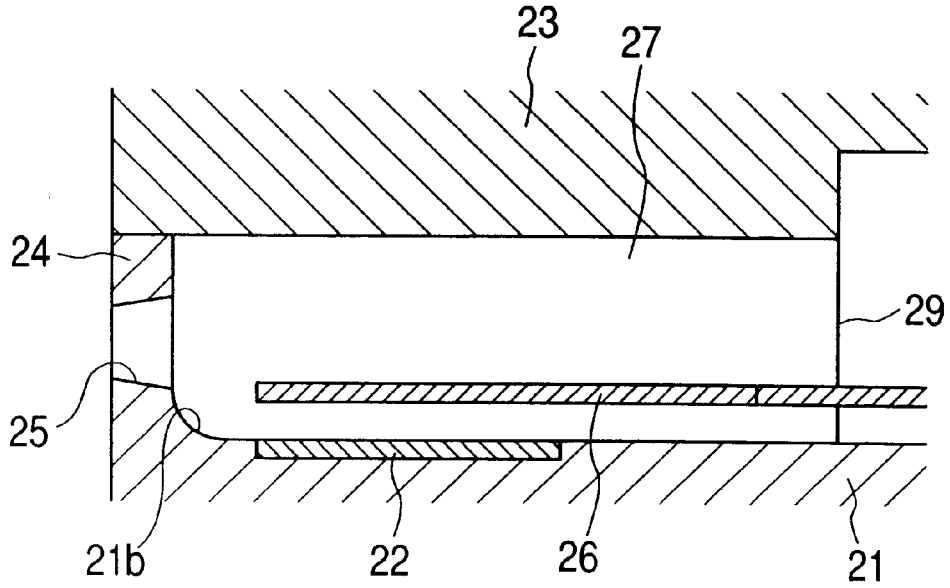
FIGS. 4A and 4B are views of a liquid discharge head of a second embodiment according to the present invention, particularly.
Figure 4B:
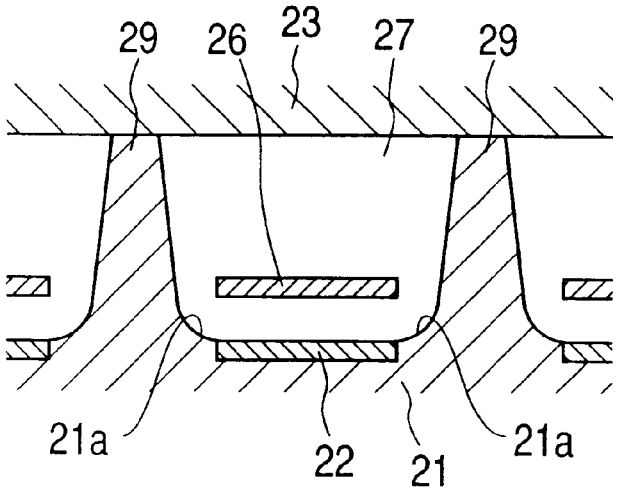

FIGS. 4A and 4B are views of a liquid discharge head of a second embodiment according to the present invention. Particularly, FIG. 4A is a sectional view taken along the direction of a flow path of the head, and FIG. 4B is a cross-sectional view of a liquid flow path thereof.

A liquid discharge head of a second embodiment of the present invention also includes an element substrate 21, top plate 23, and movable member 26. The thickness in each of liquid flow path side walls 9 is tapered in the height direction thereof. Thus, this liquid discharge head of the second embodiment is different from that of the first embodiment in that the width of the liquid flow path 27 becomes larger, as the development of the movable member 26 is increased. Other points of the second embodiment that a discharge port-formed orifice plate section 24 and the flow path side walls 29 are integrally formed with the element substrate 21 by a process of forming films on a silicon substrate, a plurality of heating elements 22 are provided on the element substrate 21, and a heating element-formed surface of the element substrate 21 is smoothly and continuously connected to the inner surface of the orifice plate section 24 and the side wall of the flow path side walls 29 so as to form curved surfaces 21*a* and a curved surface 21*b*, are substantially the same as in the first embodiment. Thus, such explanation is omitted.

Figure 5A:
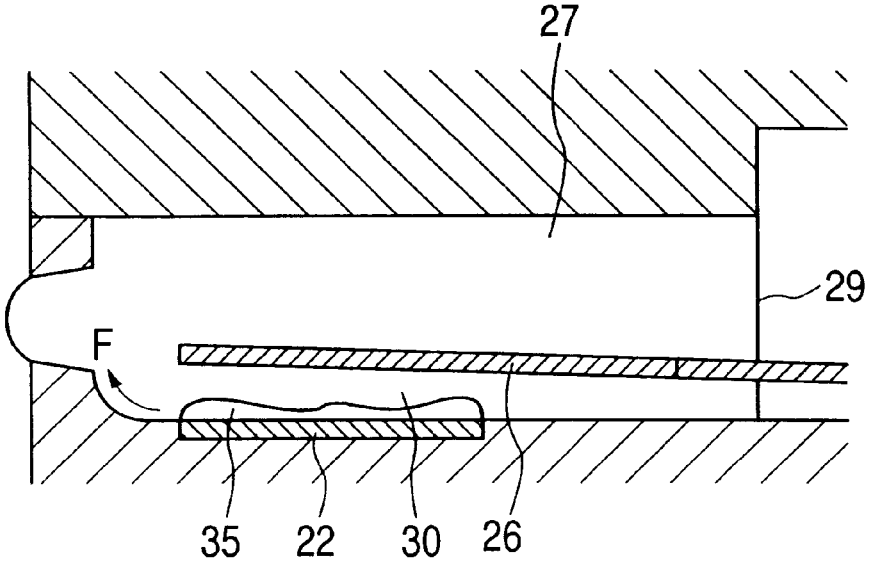
FIGS. 5A and 5B each show a state where bubbles are generated by the film boiling in the liquid discharge head shown in FIGS. 4A and 4B, particularly.
Figure 5B:
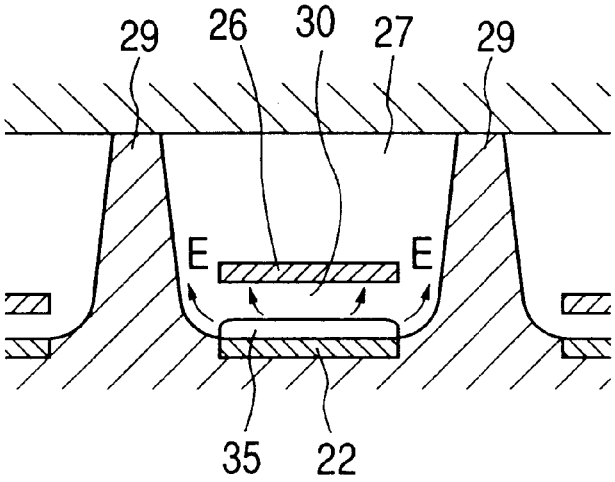

As shown in FIGS. 5A and 5B, when a bubble 35 due to the film boiling is generated in a bubble generation region 30, the movable member 26 is displaced and, at the same time, flows E and F of liquid in the generation region 30 are generated. Since the flow path side walls have an above-mentioned tapered thickness and the width of the liquid flow path 27 becomes larger as the development of the movable member 26 is increased, the liquid which was in the bubble generation region 30 is further apt to flow into between the movable member 26 and the flow path side walls 29. As a result, the support of the movable member 26 can be strengthened with the liquid flowed therebetween and a slight transverse movement can be restrained during a desired displacement thereof. Accordingly, the discharge stability and the durability of the movable member 26 can be further enhanced.

Third Embodiment

Figure 6A:
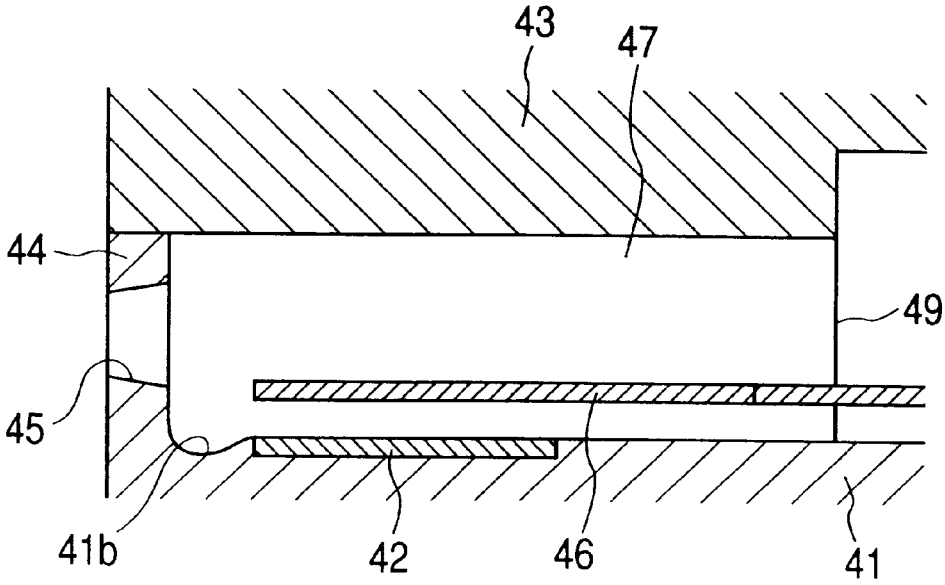
FIGS. 6A and 6B are views of a liquid discharge head of a third embodiment according to the present invention, particularly.
Figure 6B:
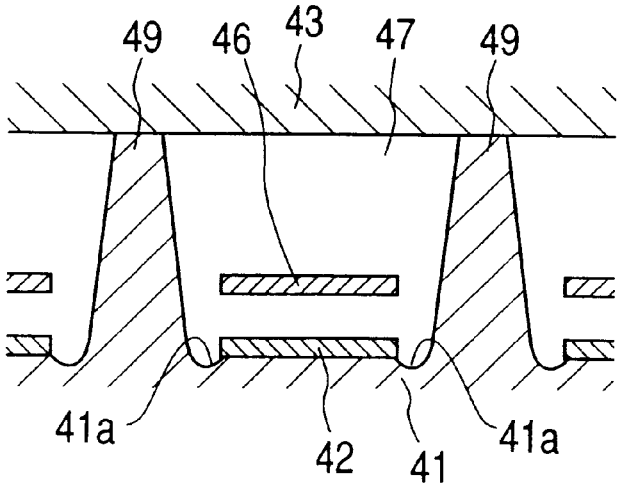

FIGS. 6A and 6B are views of a liquid discharge head of a third embodiment according to the present invention. Particularly, FIG. 6A is a sectional view taken along the direction of a flow path of the head, and FIG. 6B is a cross-sectional view of a liquid flow path thereof.

A liquid discharge head of the third embodiment also includes an element substrate 41 provided with a plurality of heating elements thereon, a top plate 43 which forms a liquid flow path 47 by connecting it to the element substrate 41, and a movable member 46 provided in the liquid flow path 47, as in the second embodiment. Further, a discharge port 5-formed orifice plate section 44 and tapered flow path side walls 49 are integrated with the element substrate 41.

Differences between the liquid discharge head of the third embodiment and the liquid discharge head of the second embodiment is a shape of the curved surface 41*b*, which is provided between the heating element 42-mounted surface of the element substrate 41 and the inner surface of the orifice plate section 44, and a shape of the curved surface 41*a* which is provided between the heating element 42-mounted surface and the surface of the flow path side walls 49. The curved surfaces 41*a* and 41*b* each forms a concave surface in the heating element 42-mounted surface. Also, portions adjacent to the orifice plate section 44 and the flow path side wall 49 have a recessed concave shape. Since other configurations of the third embodiment is substantially the same as those of the second embodiment, the explanation thereof is omitted.

Now, a discharge operation of a liquid discharge head of the present third embodiment will be described with reference to FIGS. 7A to 7D and FIGS. 8A to 8D. FIGS. 7A to 7D are sectional views taken along the liquid flow path for explaining a discharge operation of the liquid discharge head shown in FIGS. 6A and 6B. FIGS. 8A to BD are cross-sectional views of the liquid flow path for explaining the discharge operation of the liquid discharge head shown in FIGS. 6A and 6B. The steps of FIGS. 8A to 8D correspond to the steps of FIGS. 7A to 7D, respectively.

Figure 7A:
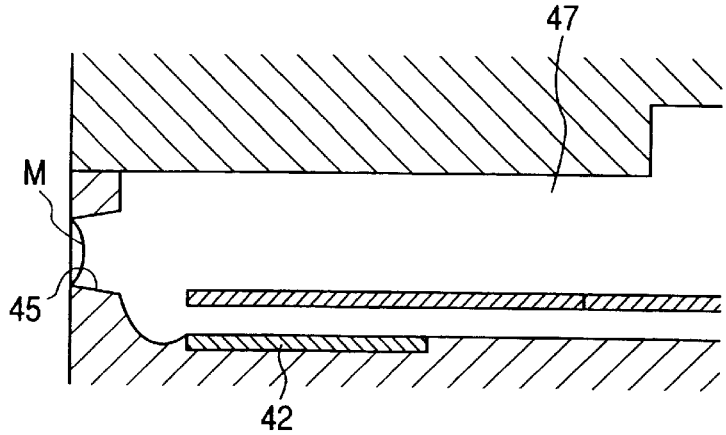
FIGS. 7A, 7B, 7C and 7D are longitudinal-sectional views taken along the liquid flow path for explaining a discharge operation for the liquid discharge head shown in FIGS. 6A and 6B.
Figure 8A:
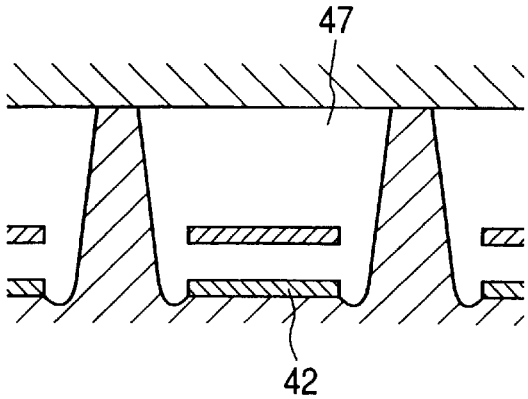
FIGS. 8A, 8B, 8C and 8D are cross-sectional views of the liquid flow path for explaining a discharge operation for the liquid discharge head shown in FIGS. 6A and 6B.

FIGS. 7A and 8A show a state before a heating element 42 is heated. In this state, a liquid flowed into a liquid flow path 47 forms a meniscus M at a discharge port 45, with the liquid flow path filled with liquid.

Figure 7B:
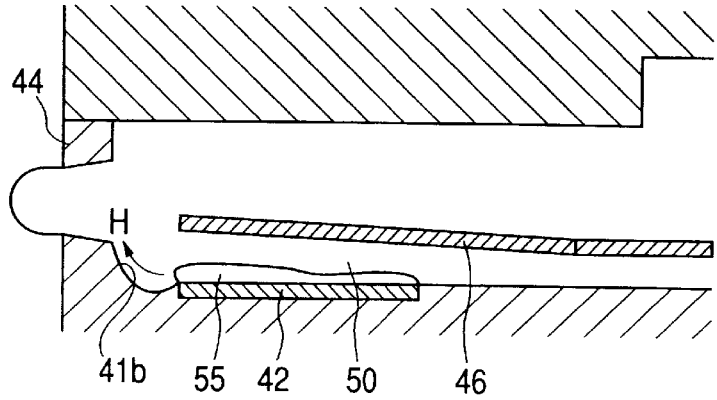
Figure 8B:
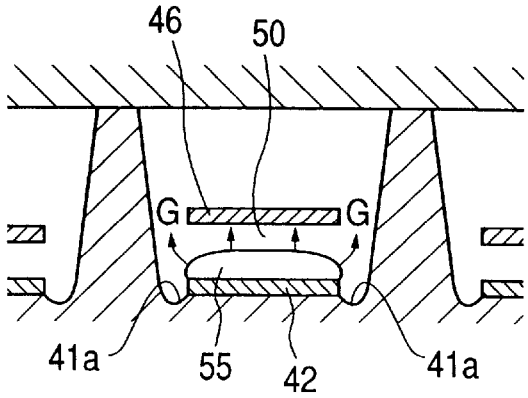

When the heating element is heated, a bubble 55 due to a film boiling is generated on the heating element 42 by generated heat, as shown in FIGS. 7B and 8B. After that, a movable member 46 is displaced by pressure due to the generation of the bubble 55. During this displacement of the movable member 46, a liquid which was in a bubble generation region 50 forms liquid flows G which are oriented toward flow path side walls 49 and a liquid which was in the region 50 forms a liquid flow H which is oriented toward the orifice plate section 44. These flows G and H are flowed along the curved surfaces 41*a* and 41*b*, respectively. As described above, each of the curved surfaces 41*a* and 41*b* has a concave surfaces on the heating element 42-mouted surface of the element substrate 41. Accordingly, a liquid which was in the bubble generation region 50 can be further easily flowed toward the flow path side walls 49 and the orifice plate section 44 than in the second embodiment. As a result, a slight transverse movement of the movable member 46 is prevented by the flows G, the movable member 46 is smoothly displaced and the discharge stability is enhanced by the flow H.

Figure 7C:
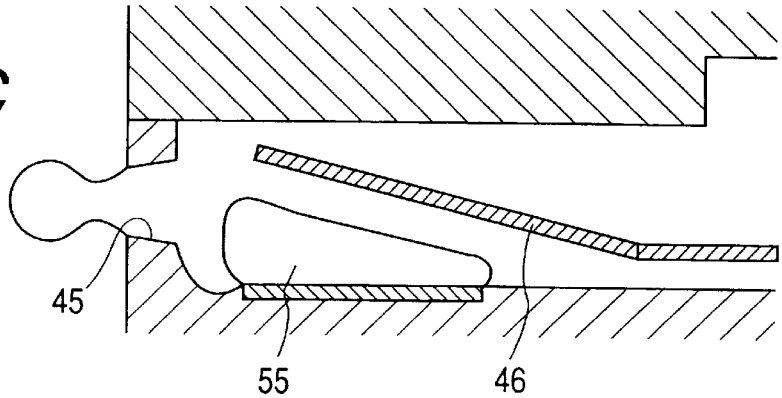
Figure 8C:
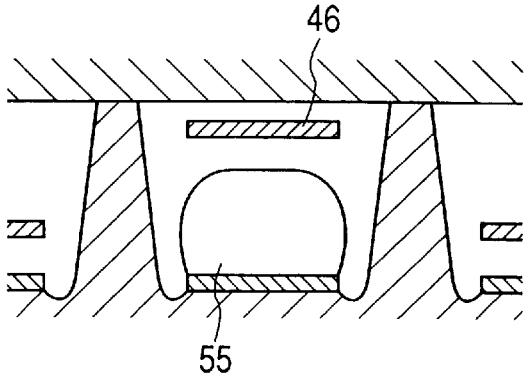

Then, as shown in FIGS. 7C and 8C, when the bubble 55 is further grown, the movable member 46 is displaced so that it is opened on the discharge port 45 side. Thus, propagation of the pressure due to generation of the bubble 55 and the growth of the bubble itself are led to the discharge port 45 side and liquid is discharged from the discharge port 45.

Figure 7D:
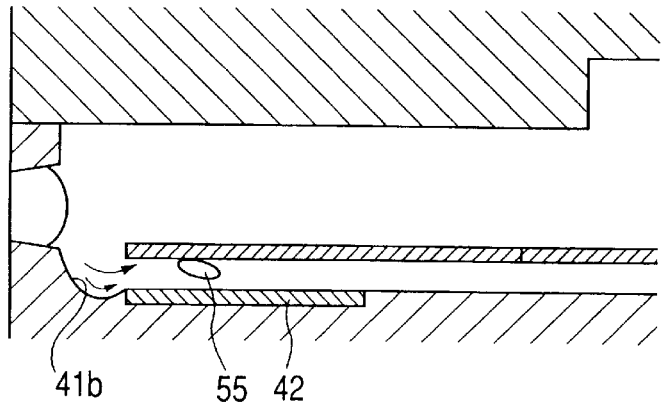
Figure 8D:
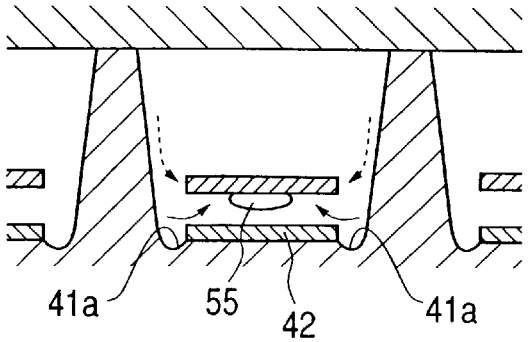

Then, as shown in FIGS. 7D and 8D, when the bubble 55 enters a bubble vanishment step, eddy flows I and J are generated by the curved surfaces 41*a* and 41*b* has a concave surfaces on the heating element 42-mouted surface of the element substrate 41. Thus, the eddy flows are larger than in the first embodiment and second embodiment. As a result, an action which allows the bubble 55 to separate from the heating element 42 is promoted, whereby the life of the heating element 42 can be enhanced.

Production Method of Liquid Discharge Head

A production method of a liquid discharge head of the present embodiment will now be described. FIGS. 9A1, 9A2 to 9J1, 9J2 are step views for explaining a production method of the liquid discharge head described above. FIGS. 9A1 to 9J1 are sectional views in a direction vertical to the direction of a liquid flow path. FIGS. 9A2 to 9J2 are cross-sectional views taken along the direction of the liquid flow path. A liquid discharge head of the present embodiment is produced by steps of from a step shown in FIGS. 9A1 and 9A2 to a step shown in FIGS. 9J1 and 9J2.

First, as shown in FIGS. 9A1 and 9A2, a phospho-silicate glass (PSG) film 101 is formed on the entire heating element 2 side surface of a substrate 1, by a chemical vapor deposition (CVD) process at a temperature of 350° C. The thickness of this PSG film 101 corresponds to the gap between the movable member 6 and heating element 2 shown in FIGS. 1A and 1B. In this embodiment, a PSG film having a thickness of 1 to 20 $\mu$m was formed. Such thickness of the PSG film remarkably leads to an important effect of the movable member 6 from the balance of the entire liquid flow path of the liquid discharge head. After that, to pattern the PSG film 101, resist is coated on the surface of the PSG film 101 by a spin coating process and exposed and developed by a photolithography technology, and a resist portion which corresponds to a movable member 6-fixed portion is removed.

After that, as shown in FIGS. 9B1 and 9B2, a PSG film portion which is not covered with the resist is removed by a wet etching process using a buffered hydrogen fluoride (HF). After that, the resist which remains on the surface of the PSG film 101 is removed by an oxigen plasma ashing process or by immersing the element substrate 1 in a resist removing agent. By this process a part of the PSG film 101 is left on the surface of the element substrate 1, whereby the part of the PSG film 101 becomes a pattern member which has a corresponding gap of the gas generation region 10. By the above-mentioned steps, the pattern member which has a corresponding gap of the gas generation region 10 is formed on the element substrate 1.

Then, as shown in FIGS. 9C1 and 9C2, on the surfaces of the element substrate 1 and the PSG film 101 is formed a SiN film 102 having a thickness of 1 to 10 $\mu$m as a first material layer by a spattering process. A part of the SiN film 102 becomes a movable member 6. As the composition of the SiN film 102, $Si_3N_4$ may be the most preferable, but a ratio of Si to N may be 1 to 1 to 1.5 to obtain the effect of the movable member 2. The SiN film is generally used in a semiconductor process and has alkali resistance, chemical stability, ink resistance and the like.

A part of the SiN film 102 becomes a movable member 2. Therefore, since a material of the SiN film 102 has a structure and composition which can obtain the optimum physical property value as a movable member 2 according to the present invention, the production method of the SiN film is not limited. For example, as a process for producing the SiN film 102, a normal pressure CVD, LPCVD, bias ECR CVD, microwave CVD process or a sputtering process or a coating process may be used in place of the above-described spattering process. Alternatively, to further enhance the physical properties, such as stress, stiffness, young ratio or the like, or the chemical properties, such as alkali resistance, acid resistance or the like in accordance with its use, a multilayered SiN film, each layer having different compositions, may be used in place of the single SiN film 102. Alternatively, a multilayered SiN film whose layers have gradually increased impurity additives, and an impurity additives-added and single-layered SiN film may be also used.

Then, as shown in FIGS. 9D1 and 9D2, an etching resistance protective film 103 is formed on a surface of the SiN film 102. As the etching resistance protective film 103, an aluminum film having a thickness of 2 $\mu$m is formed. This etching resistance protective film 103 protects damage to the SiN film 102 which will become a movable member 6, in an etching process for forming flow path side wall 9 in the next step. If the material of the movable member 6 is the same as that of the flow path side wall 9, the movable member 6 is simultaneously etched in the etching for forming the flow path side wall 9 and prevention of etching damage to the movable member 6 is needed. Accordingly, the etching resistance protective film 103 is formed on the SiN film 102.

Then, to form desired shapes of the SiN film 102 and etching resistance protective film 103, resist is applied on a surface of the etching resistance protective film 103 by a spin coating process etc., and patterned by a photolithography technology. After that, as shown in FIGS. 9E1 and 9E2, the SiN film 102 and etching resistance protective film 103 are etched by a dry etching process using a $CF_4$ gas or a reactive ion etching or the like to form a desired shape of the movable member 6. As a result a movable member 6 is formed on the element substrate 1. In this patterning steps, although the etching resistance protective film 103 and SiN film 102 were simultaneously patterned, only the etching resistance protective film 103 may be first patterned and subsequently SiN film 102 may be patterned.

Then, as shown in FIGS. 9F1 and 9F2, on the entire exposed surfaces of the etching resistance protective film 103, the PSG film 101 and the element substrate 1 is formed a second SiN film 104 having a thickness of 20 to 40 $\mu$m. If a high speed formation of the SiN film 104 is selected, a micro-wave CVD is used. This SiN film 104 finally forms flow path side walls 9. The SiN film 104 are independent of film properties which are required in a production process of a semiconductor devices, for example, pin hole density and film denseness. The SiN film 104 may be used if it satisfies ink resistance and mechanical strength as the flow path side wall 9. Nevertheless, even though the SiN film 104 has a slightly high pin hole density by a high speed formation thereof, any problem do not arise.

In this embodiment, although SiN film was used, a SiN film containing impurities or a SiN film having other composition, which has the mechanical properties and ink resistance, may be used. Alternatively, a diamond film, amorphous carbon hydroxide film (diamond line carbon film) or alumina and zirconia type inorganic film may also be used.

Then, to form a desired shape of the SiN film 4, resist is applied on the surface of the SiN film 104 by a spin coating process or the like and patterned so as to leave corresponding portions of the flow path side wall 9 and orifice plate 4 by a photolithography technology. After that, the SiN film 104 is etched by use of a reactive ion etching process in which an accelerated voltage (RF bias power) of $CF_4$ gas as a reactive gas is set low at the order of 100 W. Thus, as shown in FIGS. 9G1 and 9G2, an orifice plate 4 and flow path side walls 9 respectively having a thickness of 2 to 30 $\mu$m and concave curved surfaces 1*a* and 1*b* are simultaneously formed on the surface of the element substrate.

Then, as shown in FIGS. 9H1 and 9H2, the etching resistance protective film 103 on the SiN film 102 is removed by a wet etching or dry etching process.

Then, as shown in FIGS. 9I1 and 9I2, a PSG film beneath the SiN film 102 is removed with a buffered hydrogen fluoride.

After that, as shown in FIGS. 9J1 and 9J2, the orifice plate 4 is irradiated with an excimer laser to perform a laser ablation, thereby forming a discharge port t in the orifice plate 4. In this laser ablation, molecular bonds of SiN film are directly cut with a KrF excimer laser having a light energy of 115 kcal/mol which is larger than the bond dissociation energy of 105 kcal/mol of SiN. Since this excimer laser processing is a non-thermal processing, a high dimension accuracy processing can be carried out without thermal sagging around the processed portions, and carbonization of SiN. After that, the orifice plate 4 is connected to the top plate 3 from above position to produce a liquid discharge head.

In the above-mentioned production method of the liquid discharge head, a movable member 6 and a flow path side wall 9 are directly formed on an element substrate 1. Therefore, the method thereof has no assembly step and further simplified production steps, in comparison with a production method of the liquid discharge head, which has an assembly step of separately produced members. Further, since the method of the present invention does not use adhesive for adhering the movable member to other member, liquid within the first liquid flow path 7*a* and second liquid flow path 7*b* is not contaminated. Further, in the method of the present invention, the surface of the element substrate 1 is not almost damaged, and dusts, particles and the like are not produced in adhering of the movable member to other member. The respective members are produced by a semiconductor production process using a photolithography technology, etching process and the like. As a result, the movable member 6 and flow path side wall 9 can be formed with high accuracy and denseness or miniaturization. Furthermore, since the groove forming the liquid flow path 7 is formed by etching process and the curved surfaces 1*a* and 1*b* can be easily and smoothly formed.

Other Embodiments

Although main embodiments of a liquid discharge head and a method of discharging liquid were described above, embodiments which can be preferably applied to the above-mentioned embodiments will now be described.

Liquid Discharge Head Cartridge

Figure 10:
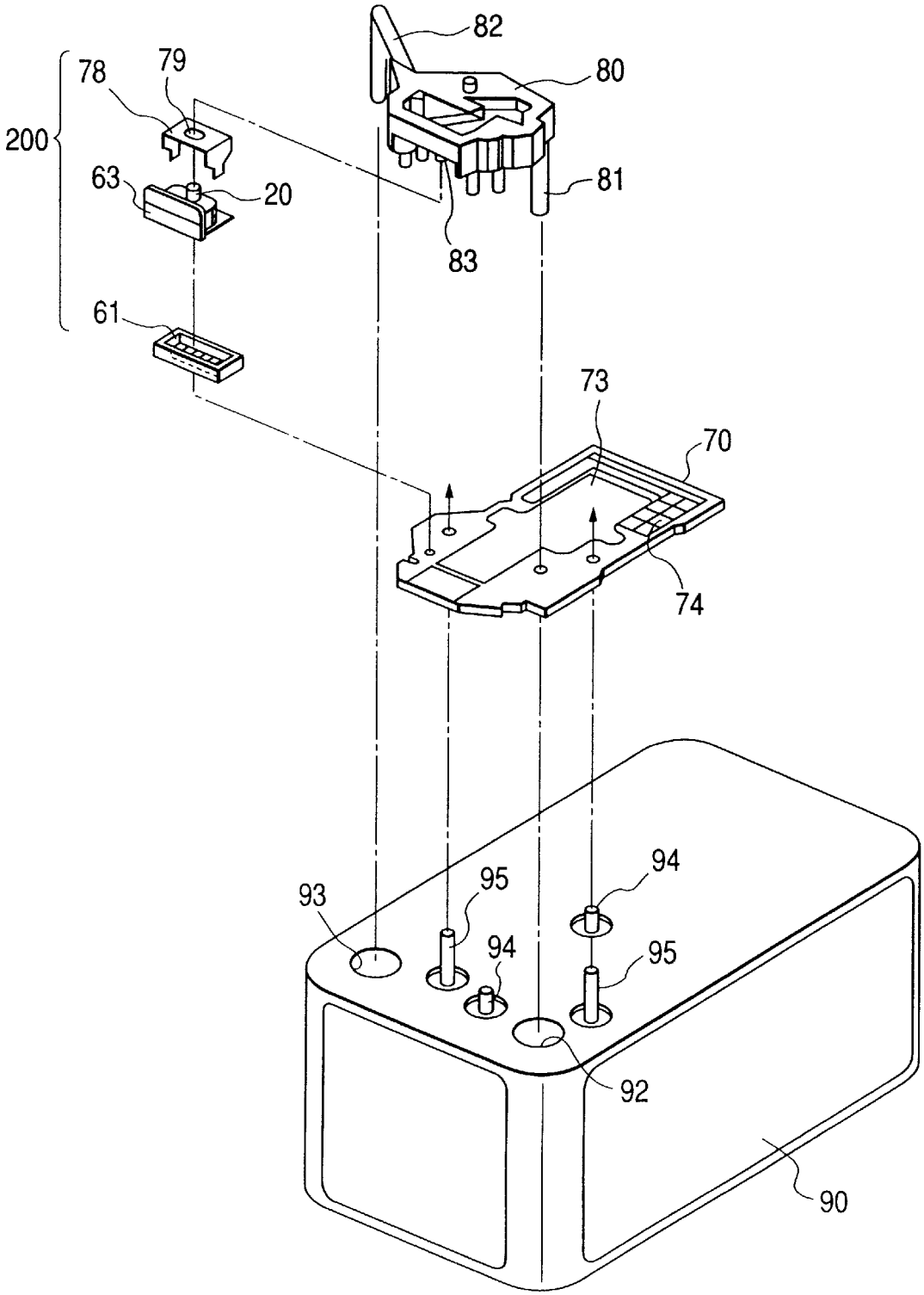
FIG. 10 is an exploded view showing a liquid discharge head cartridge according to the present invention.

A liquid discharge head cartridge including a liquid discharge head according to the above-mentioned embodiment will be described. FIG. 10 is a exploded schematic view of a liquid discharge head cartridge including the above-described liquid discharge head. The liquid discharge head cartridge mainly consists of a liquid discharge port section 200 and a liquid vessel 90.

The liquid discharge port section 200 includes an element substrate 1, a top plate 61, a press spring 78, a liquid supply member 80, an aluminum base plate (support) 70 and the like. The element substrate 1 is provided with a plurality of heating resistors for imparting heat to liquid as mentioned above, in some rows. Further, the element substrate 1 is provided with a plurality of functional elements for selectively driving this heating resistors. By the connection of the element substrate 1 and the top plate 63 a liquid flow path (not shown), through which a liquid to be discharged, is formed.

The press spring 78 is a member which biases the top plate 63 in the direction of the element substrate 61. The biasing force allows the element substrate 61, the top plate 63, and the support, which will be described later, to effectively integrate.

The support 70 supports the element substrate 61 and the like. On this support 70 are provided a printed circuit board 73 connected to the element substrate 61, for supplying electric signals, and contact pads 74 for sending signals to devices and receiving signals from them by connecting the pads to the devices.

The liquid vessel 90 receives a liquid which is supplied to the liquid discharge head section 200. Outside the liquid vessel 90 are provided a positioning section 94 for positioning a connecting member which connects the liquid discharge head section 200 to the liquid vessel 90, and a fixed shaft for fixing the connecting member. Liquid is supplied from liquid supply paths 92 and 93 of the liquid vessel 90 to liquid supply paths 81 and 82 of the liquid supply member 80 through a supply path of the connecting member, and the liquid is supplied to a common liquid chamber through liquid supply paths 83, 79, and 20 of the respective members. In this embodiment, the liquid supply from the liquid vessel 80 to the liquid vessel 90 is carried out with two flow paths. However, such liquid supply using two flow paths is not necessarily required.

Liquid Discharge Device

Figure 11:
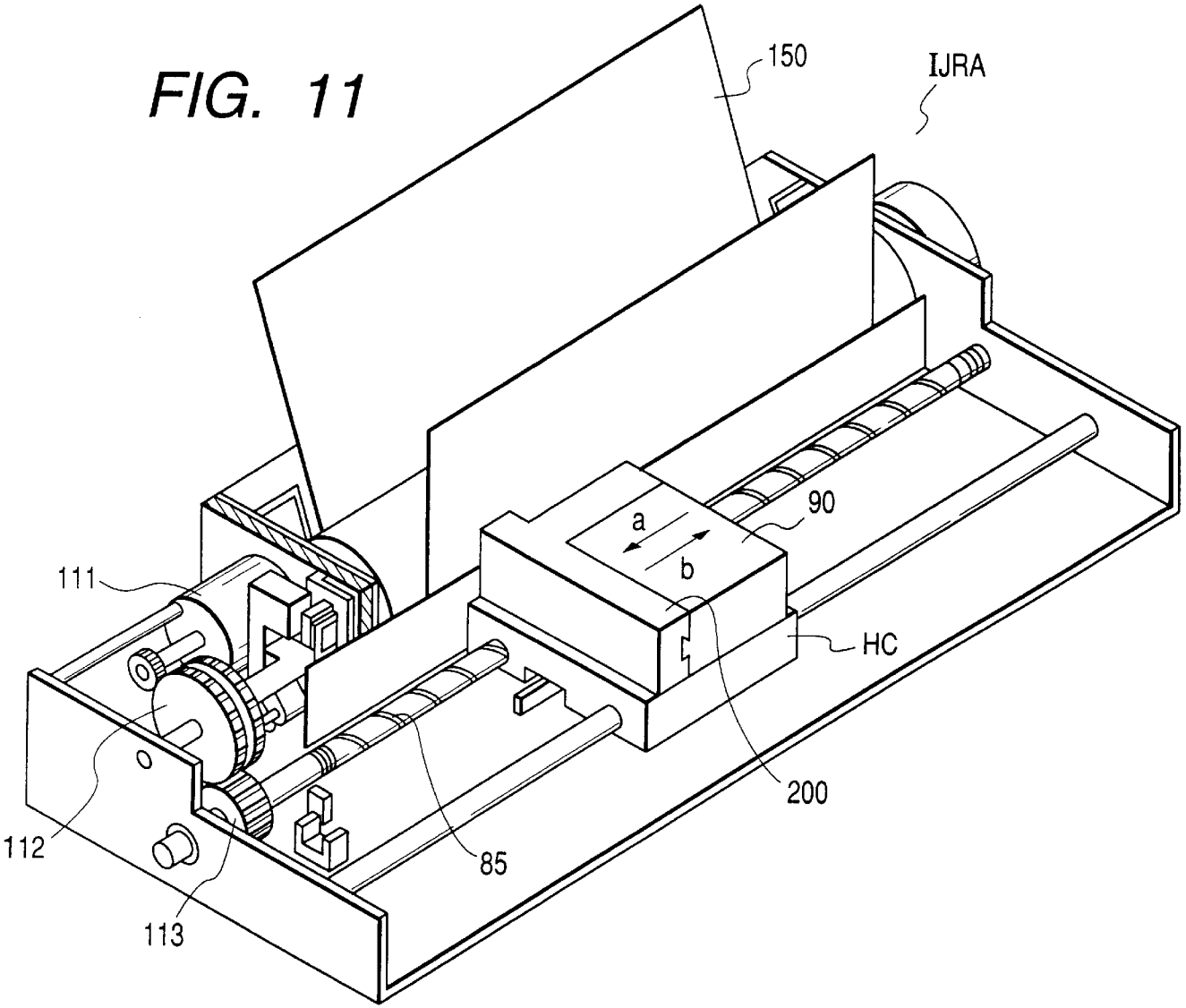
FIG. 11 is a perspective view showing a main portion of a liquid discharge device according to the present invention.

FIG. 11 shows a schematic configuration of a liquid discharge device including the above-described liquid discharge head. This embodiment will be explained by use of an ink discharge recording or printing apparatus (IJRA) using ink as a discharge ink. A carriage HC of the liquid discharge device includes a head cartridge having a detachable liquid vessel 90 which receives ink and a detachable liquid discharge head section 200. The cartridge HC is reciprocated in width directions (arrows a and b in FIG. 11) of a recording medium 150, such as a paper and the like which are fed with a recording medium feeding means.

In FIG. 11, when a driving signal is supplied from a driving signal supply means (not shown) to a liquid discharge means on the carriage HC, a recording liquid is discharged from the liquid discharge head section 200 to the recording medium 150 in response to this driving signal.

The liquid discharge device of the present embodiment includes a motor which is used as a driving source for driving the recording medium feeding means and the carriage HC, gears 112 and 113 for transmitting a power from the driving source, to the carriage HC, and a carriage shaft 85 and the like. By using the recording device and liquid discharge method according to the present invention, a liquid is preferably discharged to various recording medium and improved printed image could be obtained.

Figure 12:
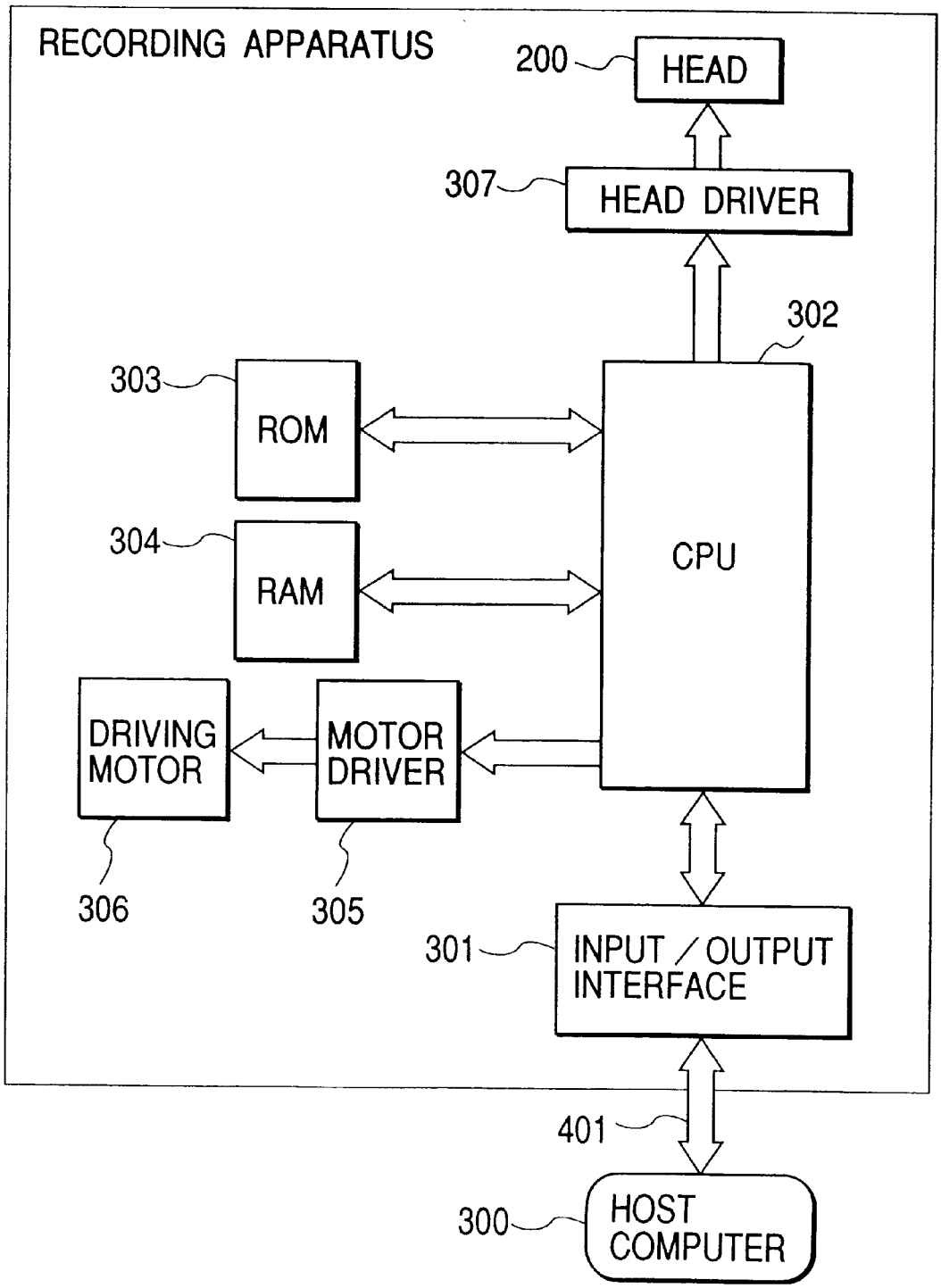
FIG. 12 is a block diagram of a liquid discharge device according to the present invention.

FIG. 12 is a block diagram of the entire device for operating a liquid discharge head-applied ink discharge recording device according to the present invention. The recording device receives printing information from a host computer as a control signal. When the printing information is once conserved into an input/output interface 301 in a printing device, it is simultaneously converted to processable data in the recording device and input to a CPU 302 which also functions as a head driving signal supply means. The CPU 302 is processed by use of a peripheral unit, such as RAM 304 etc. based on a control program conserved in a ROM 303, and is converted to image data to be printed.

The CPU 302 prepares driving data for driving a driving motor 306 which is synchronized with image data and moves a recording paper and the head 200 so that the image data is recorded at proper positions on the recording paper. The image data and the motor driving data are transferred to the head 200 and the driving motor 306 through the head driver 307 and the motor driver 305, respectively, and are driven at respectively controlled timing to make images.

As recording medium which can be applied to the above-described recording device and to which ink or the like is imparted, various type papers, an OHP sheet, plastic materials used as a compact disk, a decorative plate etc., clothes, metallic materials such as aluminum, copper and the like, leather materials, such as a cow skin, a pig skin, an artificial skin etc., wood such as a tree, a plywood and the like, bamboo materials, seramics materials such as a tile and the like, and three-dimensional structure such as sponge and the like, can be used.

The above-described recording device includes a printer device which uses various type papers, an OHP sheet and the like, a plastic recording device which records on images plastic materials such as a compact disk and the like, a metal recording device which records images on a metallic plate, a leather recording device which records images on a leather material, a wood recording device which records images on a wood material, a ceramics recording device which records images on a ceramics material, a recording device which records images on three-dimensional structure such as sponge and the like, and a printing equipment which records images on a cloth material, and the like.

As a discharge liquid which is used in these liquid discharge device, a liquid which is suitable for the respective recording mediums and recording conditions may be used.

Recording System

Figure 13:
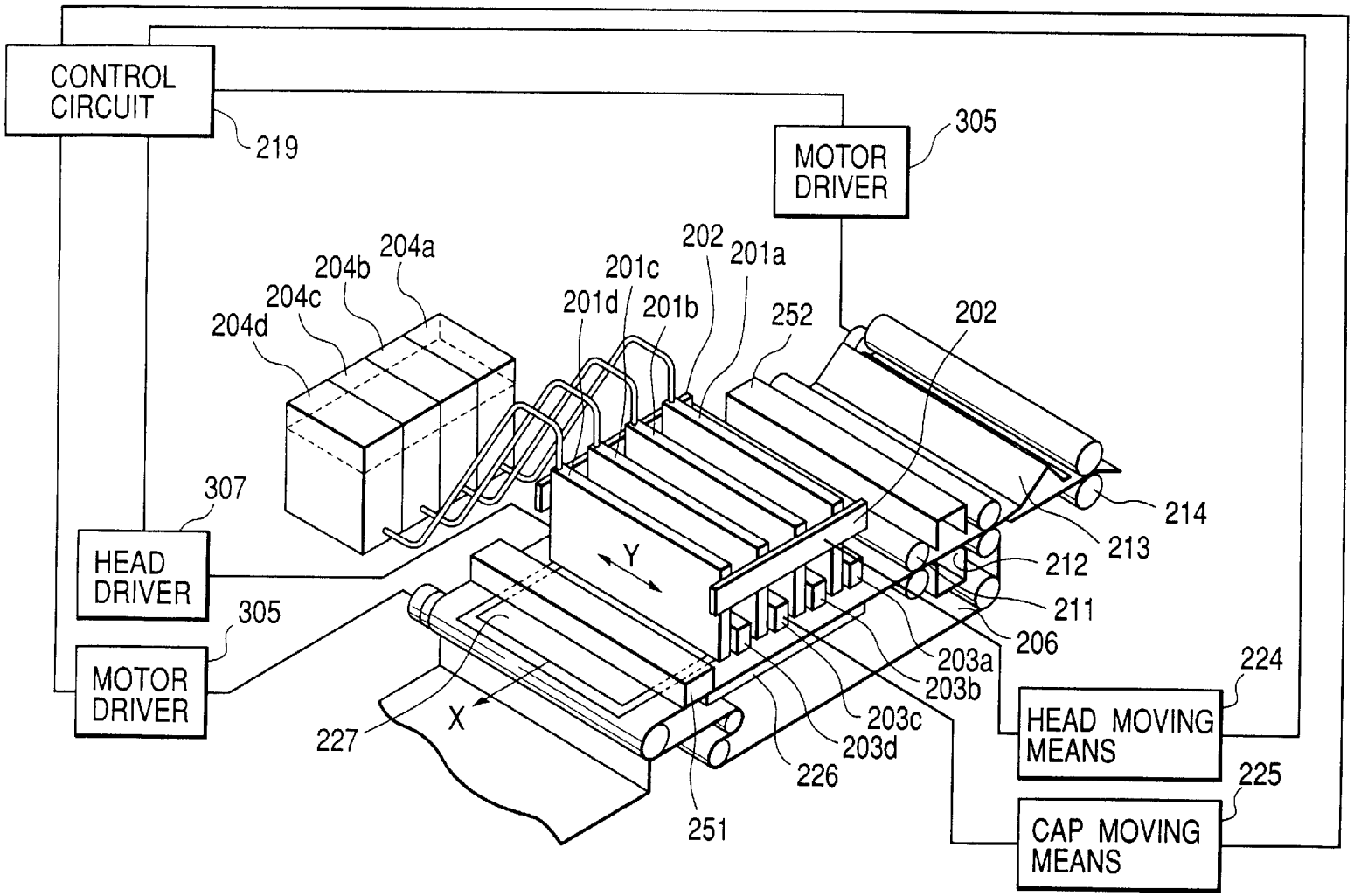
FIG. 13 is a perspective view showing a main portion of a liquid discharge system according to the present invention.

An embodiment of an ink jet recording system using a liquid discharge head of the present invention as a recording head, and records images on a recording medium, will now be described. FIG. 13 is a schematic view for explaining the configuration of the ink jet recording system using the above-described liquid discharge head of the present invention. The liquid discharge head of the present embodiment is a full-line type head provided with a plurality of discharge ports with each interval of 360 dpi in a distance corresponding to the recordable width of the recording medium 150. Four liquid discharge heads 201*a* to 201*d* corresponding to four colors of yellow (Y), magenta (M), cyan (C), and black (Bk), respectively, are fixedly supported by a holder 202, while having desired intervals in the direction of X.

Signals are supplied from a head driver 307 which forms the respective driving signal supply means to these heads 201*a* to 201*d*, and each of the heads 201*a* to 201*d* is driven in response to the signals. To the heads 201*a* to 201*d* are supplied Y, M, C and Bk colored discharge ink from ink vessels 204*a* to 204*d*, respectively.

Head caps 203*a* to 203*d* provided with an ink absorbing member such as a sponge therein are provided below the heads 201*a* to 201*d*, respectively, and maintain the heads 201*a* to 201*d* by covering the respective discharge ports of the heads 201*a* to 201*d* at the recording-off time. The reference numeral 206 denotes a belt conveyer which forms a feeding means for feeding various recording mediums mentioned above. The belt conveyor 206 is rotated with rollers in a desired route, and is driven by a driving roller connected to a motor driver.

In the ink jet recording system of the present embodiment, a pretreatment device 251 and a post-treatment device 252, which treat a recording medium before and after the recording respectively, are provided in the upstream side and the downstream side of the feeding route of the recording medium, respectively. The pretreatment and the post-treatment carry out different treatments in accordance with the types of the recording medium and the types of ink. For example, in a case of use a recording medium such as metal, plastic, ceramics, or the like, as the pretreatment, irradiation of ultraviolet rays and ozone are performed, and the surface of the recording medium is activated, thereby enhancing the adhesion properties. Alternatively, in a case of use of a recording medium, such as plastic or the like, which is apt to generate static electricity, dust and the like are apt to adhere the surface of the recording medium, by the static electricity, whereby a better recording is sometimes prevented.

To prevent the problem of the static electricity, the static electricity of the recording medium is removed by use of an ionizer apparatus as a pretreatment and the generation of dust can be prevented. Alternatively, in a case of use of cloth as a recording medium, a pretreatment of adhering a matter selected from a group consisting of an alkaline matter, a water-soluble matter, a synthetic polymer, a water-soluble metal salt, urea, and thiourea, to the cloth is effective from view points of the prevention of bleeding (ink etc.) and enhancement of the degree of exhaustion. A pretreatment of keeping a temperature of a recording medium to a desired one which is suitable for recording is useful. On the other hand, the post-treatment includes thermal treatment of an ink-imparted recording medium, a fixing treatment for promoting the fixation of ink by irradiation of ultraviolet rays, and a cleaning process of cleaning non-reacted treatment left in the pretreatment.

Although, as the heads 201*a* to 201*d*, a full line head was used in the present embodiment, another type head which feeds the above-described compact head in the width direction of the recording medium to record images may be used, without being limited to the heads 201*a* to 201*d*.

What is claimed is:

1. A liquid discharge head comprising a discharge port for discharging liquid, a liquid flow path provided with a bubble generation means for generating bubbles in liquid and communicated with said discharge port, and a movable member provided facing said bubble generation means in said liquid flow path and having a free end on a downstream side toward said discharge port, a first surface provided with said bubble generation means being continued to at least one second surface of a side wall surface of said liquid flow path and a front end surface having an opening of said discharge port with a curved surface, said first surface being one of surfaces forming said liquid flow path.

2. A liquid discharge head according to claim 1, wherein as a displacement of said movable member is increased, a width of said liquid flow path is increased.

3. A liquid discharge head according to claim 1, wherein said curved surface forms a concave curved surface on the surface provided with said bubble generation means.

4. A liquid discharge head according to claim 1, wherein said bubble generation means is formed on a silicon material base substrate, and the side wall surface and front end surface of said liquid flow path are integrated with said substrate.

5. A liquid discharge method for discharging liquid by using a liquid discharge head comprising a discharge port for discharging liquid, a liquid flow path provided with a bubble generation means for generating bubbles in liquid and communicated with said discharge port, and a movable member provided facing said bubble generation means in said liquid flow path and having a free end on a downstream side toward said discharge port, a first surface provided with said bubble generation means being continued to at least one second surface of a side wall surface of said liquid flow path and a front end surface having an opening of said discharge port with a curved surface, said first surface being one of surfaces forming said liquid flow path, and displacing the free end of said movable member due to a generation of said bubbles thereby leading a pressure to said discharge port to discharge liquid, wherein when said movable member is displaced due to the generation of said bubbles, liquid is flowed between said movable member and said liquid flow path along said curved surface by a growth of said bubbles.

6. A liquid discharge method according to claim 5, wherein as a displacement of said movable member is increased, a width of said liquid flow path is increased.

7. A liquid discharge method according to claim 5, wherein said curved surface forms a concave curved surface on the surface provided with said bubble generation means.

8. A liquid discharge method according to claim 5, wherein said bubble generation means is formed on a silicon material base substrate, and the side wall surface and front end surface of said liquid flow path are integrated with said substrate.

9. A head cartridge comprising the liquid discharge head according to claim 1, and a liquid vessel for containing liquid which is supplied to said liquid discharge head.

10. A liquid discharge device comprising the liquid discharge head according to claim 1, and a driving signal supply means for supplying driving signals for discharging liquid from said liquid discharge head.

11. A liquid discharge device comprising the liquid discharge head according to claim 1, and a recording medium feeding means for feeding a recording medium which receives a discharged liquid from said liquid discharge head.

12. A liquid discharge device according to claim 10 or 11, wherein recording is carried out by discharging ink from said liquid discharge head, and applying ink to said recording medium.

13. A liquid discharge device according to claim 10 or 11, wherein color recording is carried out by discharging recording liquids having different colors respectively from said liquid discharge head, and applying said recording liquids to said recording medium.

14. A liquid discharge device according to claim 10 or 11, wherein a plurality of said discharge ports are provided over an entire width of a recordable region of said recording medium.

* * * * *

UNITED STATES PATENT AND TRADEMARK OFFICE

CERTIFICATE OF CORRECTION

PATENT NO. : 6,095,640
DATED : August 1, 2000
INVENTOR(S) : Hiroyuki Ishinaga et al.

It is certified that error appears in the above-identified patent and that said Letters Patent is hereby corrected as shown below:

Column 1,
Line 30, "so called a" should read -- a so-called --; and
Line 57, "are" should read -- have --.

Column 2,
Line 43, "view points" should read -- viewpoints --.

Column 3,
Line 27, "epock-making" should read -- epoch-making --.

Column 4,
Line 21, "movable" should read -- movable member --; and
Line 48, "a" should be deleted.

Column 5,
Line 43, "element" should read -- elements --; and
Line 60, "applying" should read -- supplying --.

Column 7,
Line 17, "member 15." should read -- member 6. --; and
Line 50, "displaced" should read -- displaced member --.

Column 8,
Line 6, "not almost" should read -- not fully --;
Line 33, "contacted" should read -- contracted --; and
Line 41, "This" should read -- These --.

Column 9,
Line 7, "increase" should read -- increasing --;
Line 61, "to back" should read -- to flow back --;
Line 63, "generated" should read -- generates --; and
Line 66, "reduced" should read -- reduces --.

UNITED STATES PATENT AND TRADEMARK OFFICE

CERTIFICATE OF CORRECTION

PATENT NO. : 6,095,640
DATED : August 1, 2000
INVENTOR(S) : Hiroyuki Ishinaga et al.

It is certified that error appears in the above-identified patent and that said Letters Patent is hereby corrected as shown below:

Column 10,
Line 3, "member 31," should read -- member 6, --;
Line 6, "view points" should read -- viewpoints --; and
Line 23, "walls 9" should read -- walls 29 --.

Column 11,
Line 16, "is" should read -- are --;
Line 24, "BD" should read -- 8D --;
Line 45, "surfaces" should read -- surface -- and "42-mouted" should read -- 42-mounted --;
Line 62, "eddy flows I and J" should read -- eddy flows --; and
Line 64, "surfaces" should read -- surface -- and "42-mouted" should read -- 42-mounted --.

Column 12,
Lines 46 and 63, "spattering" should read -- sputtering --.

Column 13,
Line 44, "do" should read -- does --; and
Line 52, "SiN film 4," should read -- SiN film 104, --.

Column 14,
Line 6, "port t" should read -- port 5 --;
Line 29, "not almost" should read -- not fully --;
Line 37, "process and" should read -- process, --; and
Line 61, "this" should read -- these --.

UNITED STATES PATENT AND TRADEMARK OFFICE

CERTIFICATE OF CORRECTION

PATENT NO. : 6,095,640
DATED : August 1, 2000
INVENTOR(S) : Hiroyuki Ishinaga et al.

It is certified that error appears in the above-identified patent and that said Letters Patent is hereby corrected as shown below:

Column 16,
Line 11, "sermaics" should read -- ceramics --; and
Line 27, "device," should read -- devices, --.

Column 17,
Line 9, "adhere" should read -- adhere to --; and
Line 20, "view points" should read -- viewpoints --.

Signed and Sealed this

Fifteenth Day of January, 2002

*Attest:*

*Attesting Officer*

JAMES E. ROGAN
*Director of the United States Patent and Trademark Office*